US010183491B2

(12) United States Patent
Suzuki et al.

(10) Patent No.: US 10,183,491 B2
(45) Date of Patent: Jan. 22, 2019

(54) CAP ATTACHED TO INK TANK OF PRINTER

(71) Applicant: Seiko Epson Corporation, Tokyo (JP)

(72) Inventors: Hidenao Suzuki, Matsumoto (JP); Naomi Kimura, Okaya (JP); Shoma Kudo, Shiojiri (JP); Soshi Okawa, Shiojiri (JP); Koji Kawai, London (GB); Ekie Purnomo, Banten (ID); Muhamad Gigih Agung Pratomo, Jawa barat (ID); Muhamad Auf, Jawa barat (ID)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/459,619

(22) Filed: Mar. 15, 2017

(65) Prior Publication Data

US 2017/0282564 A1 Oct. 5, 2017

(30) Foreign Application Priority Data

Mar. 30, 2016 (JP) ..... 2016-067516
Jun. 30, 2016 (JP) ..... 2016-129806
Jul. 13, 2016 (JP) ..... 2016-138250

(51) Int. Cl.
*B41J 2/165* (2006.01)
*B41J 2/175* (2006.01)

(52) U.S. Cl.
CPC ..... *B41J 2/16505* (2013.01); *B41J 2/17506* (2013.01)

(58) Field of Classification Search
CPC ..... B41J 2/16505; B41J 2/17506
See application file for complete search history.

(56) References Cited

U.S. PATENT DOCUMENTS

| | | | | |
|---|---|---|---|---|
| 9,079,413 | B2 | 7/2015 | Kudo et al. | |
| 9,290,001 | B2 | 3/2016 | Kudo et al. | |
| 2014/0043408 | A1 | 2/2014 | Kudo et al. | |
| 2015/0283816 | A1 | 10/2015 | Kimura et al. | |
| 2015/0306882 | A1* | 10/2015 | Kudo | B41J 2/175 347/87 |
| 2015/0360476 | A1* | 12/2015 | Osakabe | B41J 2/17553 347/85 |
| 2016/0159099 | A1 | 6/2016 | Kudo et al. | |

FOREIGN PATENT DOCUMENTS

| | | | | |
|---|---|---|---|---|
| JP | 2014-054826 | A | 3/2014 | |
| JP | 2014-223930 | A | 12/2014 | |
| JP | 2014223930 | A * | 12/2014 | B65D 51/1622 |

* cited by examiner

*Primary Examiner* — Bradley Thies
(74) *Attorney, Agent, or Firm* — Foley & Lardner LLP

(57) ABSTRACT

A tank comprises a container body configured to contain an ink and an ink fill port configured to accept the ink to be injected into the container body. A cap is provided to close the ink fill port when the cap is attached to the tank. The cap comprises a covering portion configured to cover the ink fill port; a seal portion protruded from the covering portion to be inserted into the ink fill port and configured to close the ink fill port when the seal portion is inserted in the ink fill port; and a skirt portion protruded from the covering portion in a direction of protrusion of the seal portion from the covering portion and located away from the seal portion when the covering portion is viewed from a seal portion side. The skirt portion is protruded more than the seal portion.

4 Claims, 26 Drawing Sheets

CAP ATTACHED TO INK TANK OF PRINTER

CROSS-REFERENCE TO RELATED APPLICATIONS

The present application claims priority from Japanese patent application 2016-067516 filed on Mar. 30, 2016, Japanese patent application 2016-129806 filed on Jun. 30, 2016 and Japanese patent application 2016-138250 filed on Jul. 13, 2016, the entireties of the disclosures of which are hereby incorporated by reference into this application.

BACKGROUND

The disclosure relates to a cap and a printer.

An inkjet printer has conventionally been known as one example of printer. The inkjet printer is configured to eject ink from a print head onto a printing medium such as printing paper, so as to perform printing on the printing medium. A known configuration of the inkjet printer supplies ink from a tank unit to an ejection head (for example, JP 2014-54826M.

The tank unit described in JP 2014-54826A includes a tank configured to include an ink fill port, a closing member (cap) configured to close the ink fill port, and a tank case configured to place the tank therein. A fitting portion in a ring shape is provided in the closing member to be fit in the ink fill port. The ink fill port is closed when the fitting portion of the closing member is press-fit into the ink fill port. In this tank unit, a cross portion (support portion) is provided in the tank case to support the closing member that is removed from the ink fill port. The closing member is supported by the cross portion when the inner circumference of the fitting portion is press-fit into the cross portion. Ink in the tank or ink adhering to the ink fill port in the process of ejecting ink through the ink fill port is likely to adhere to the closing member. The ink adhering to the closing member is likely to be splattered from the closing member to the circumference by the momentum of pulling out the closing member from the ink fill port or the cross portion. There is accordingly still a room for improvement in the convenience with respect to the conventional cap and the conventional printer.

SUMMARY

In order to solve at least one of the problems described above, the disclosure may be implemented by aspects described below.

(1) According to one aspect of the disclosure, there is provided a cap configured to be attached to and detached from a tank, the tank comprises a container body configured to contain an ink to be supplied to a print head; and an ink fill port configured to accept the ink to be injected into the container body. The cap configured to close the ink fill port when the cap is attached to the tank. The cap comprises a covering portion configured to cover the ink fill port; a seal portion protruded from the covering portion to be inserted into the ink fill port and configured to close the ink fill port when the seal portion is inserted in the ink fill port; and a skirt portion located outside of the seal portion when the covering portion is viewed from a seal portion side and protruded from the covering portion in a direction of protrusion of the seal portion from the covering portion. The skirt portion is protruded more than the seal portion.

In the cap of this aspect, the skirt portion, which is located outside of the ink fill port when the seal portion is inserted in the ink fill port, is protruded from the covering portion is protruded more than the seal portion. Even when ink is splattered from the seal portion, for example, by the momentum of pulling out the cap with the ink-adhering seal portion from the ink fill port, the skirt portion serves to trap the splattered ink. This configuration accordingly enhances the convenience of the cap.

(2) According to another aspect of the disclosure, there is provided a printer comprising a print head configured to eject an ink; a tank comprising a container body configured to contain the ink to be supplied to the print head and an ink fill port configured to accept the ink to be injected into the container body; a housing configured to cover at least part of a portion of the tank other than the ink fill port; and a receiving plate configured to receive a cap placed thereon, wherein the cap is configured to close the ink fill port when the cap is attached to the ink fill port of the tank. The receiving plate is provided on the housing.

In the printer of this aspect, the cap configured to close the ink fill port of the tank is allowed to be detached from the ink fill port and to be placed on the receiving plate. This configuration makes it less likely to apply the momentum of splattering ink to the cap when the cap placed on the receiving plate is lifted up from the receiving plate. The cap can thus be gently lifted up from the receiving plate. This configuration is thus less likely to splatter the ink.

(3) In the printer of the above aspect, the receiving plate may be configured to be attached to and detached from the housing.

In the printer of this aspect, the receiving plate is attachable to and detachable from the housing. This configuration enables the receiving plate to be readily cleaned by detachment of the receiving plate from the housing.

(4) In the printer of the above aspect, the receiving plate may comprise a placement surface configured to receive the cap placed thereon; and a partition wall protruded upward from the placement surface in a use attitude of the receiving plate and configured to define at least part of the placement surface. In the use attitude of the receiving plate, the placement surface may be inclined. When the placement surface is divided into two regions that are a higher region and a lower region by height difference according to inclination of the placement surface, the partition wall may be provided in at least the lower region.

In the printer of this aspect, the partition wall is arranged to define at least the lowest position of the inclined placement surface of the receiving plate. The partition wall accordingly serves to trap the ink that flows down along the inclination of the placement surface.

(5) In the printer of the above aspect, the receiving plate may comprise a rib provided on the placement surface of the receiving plate to be protruded upward from the placement surface and configured to receive the cap placed thereon.

In the printer of this aspect, the rib serves to separate at least part of the cap from the placement surface when the cap is placed on the receiving plate. This configuration suppresses ink adhering to the placement surface from adhering to the cap.

(6) In the printer of the above aspect, the rib may be provided in the lower region of the placement surface. When the cap is placed on the placement surface, a seal portion of the cap, the cap is configured to be inserted into the ink fill port of the tank, may be located in an area away from the rib across a gap.

In the printer of this aspect, the seal portion of the cap is located in the area that is away from the rib of the receiving plate across the gap when the cap is placed on the placement surface of the receiving plate. This configuration suppresses ink adhering to the seal portion from adhering to the rib of the receiving plate.

(7) In the printer of the above aspect, when the printer is viewed vertically downward in a use attitude of the printer, the receiving plate and the ink fill port may be arrayed in a first direction along one side of the printer.

(8) The printer of the above aspect may further comprise a connecting portion configured to anchor an anchor portion provided on the cap. When the printer is viewed vertically downward in the use attitude of the printer, a position of the connecting portion along the first direction may be between a position of the receiving plate along the first direction and a position of the ink fill port along the first direction.

The printer of this aspect is more likely to adjust the distance from the connecting portion to the receiving plate to the distance from the connecting portion to the ink fill port when the printer is viewed vertically downward in the use attitude of the printer.

(9) In the printer of the above aspect, when the printer is viewed vertically downward in the use attitude of the printer, the position of the connecting portion along the first direction may be between a position of center of the receiving plate along the first direction and a position of center of the ink fill port along the first direction.

The printer of this aspect is furthermore likely to adjust the distance from the connecting portion to the receiving plate to the distance from the connecting portion to the ink fill port when the printer is viewed vertically downward in the use attitude of the printer.

(10) In the printer of the above aspect, when the printer is viewed vertically downward in the use attitude of the printer, the ink fill port may be located inside of an area of the printer. When a direction, the direction intersects with the first direction, toward the ink fill port from the one side is defined as a second direction, the housing may comprise a side wall located on a second direction side of the ink fill port. The side wall may comprise an inclined wall inclined toward the second direction side from an upper side to a lower side. The connecting portion may be provided on the inclined wall.

In the printer of this aspect, the connecting portion is provided on the inclined wall of the housing. This configuration suppresses the anchor portion from being protruded from the side wall in an opposite direction that is opposite to the second direction when the anchor portion of the cap is anchored to the connecting portion.

(11) In the printer of the above aspect, a gap may be formed between the ink injection container and the connecting portion when a nozzle of an ink injection container, the ink injection container contains the ink and is configured to inject the ink through the ink fill port into the container body, is inserted in the ink fill port during ink injection and a positioning element provided on the nozzle comes into contact with an end of the ink fill port to position the inserted nozzle relative to the ink fill port.

The configuration of the printer of this aspect suppresses the ink injection container from being in contact with the connecting portion when the nozzle of the ink injection container that is provided to contain the ink and is configured to inject the ink through the ink fill port into the container body is inserted in the ink fill port during ink injection and the positioning element provided on the nozzle comes into contact with the end of the ink fill port to position the inserted nozzle relative to the ink fill port.

(12) The printer of the above aspect may comprise a plurality of the ink fill ports. A marker indicating information with regard to ink may be provided for each of the ink fill ports.

In the printer of this aspect, the marker is provided for each ink fill port. This configuration enables the plurality of ink fill ports to be distinguished from one another.

(13) In the printer of the above aspect, the marker may comprise a label attached to the housing. The label may be formed in a different shape for each of the ink fill ports. The housing may comprise attachment areas where labels corresponding to the respective attachment areas are to be attached. The attachment areas may be formed in different shapes according to shapes of the corresponding labels.

In the printer of this aspect, the attachment areas are formed in different shapes according to the labels formed in different shapes for the respective ink fill ports. This configuration suppresses each label corresponding to an ink fill port from being mistakenly attached to a wrong ink fill port.

(14) The printer of the above aspect may comprise a plurality of the receiving plates respectively provided for the plurality of ink fill ports. The marker may be provided in each of the receiving plates.

In the printer of this aspect, the marker is provided in each receiving plate that is provided for each ink fill port. This configuration enables the plurality of receiving plates to be distinguished from one another corresponding to the respective ink fill ports.

(15) In the printer of the above aspect, the tank may include a visible portion configured to make the tank visible across the housing. A marker indicating information with regard to ink may be provided in the visible portion. When the visible portion is viewed from a front side in a use attitude of the printer, a vertical line passing through a center of the receiving plate and a vertical line passing through a center of the marker provided in the visible portion may be deviated from each other.

In the printer of this aspect, when the visible part is viewed from the front side, the center of the receiving plate and the center of the marker provided in the visible portion are deviated from each other. This configuration suppresses, for example, ink dripping off from the receiving plate from adhering to the label provided in the visible portion.

(16) According to another aspect of the disclosure, there is provided a cap configured to be attached to and detached from a tank, the tank comprises a container body configured to contain an ink to be supplied to a print head; and an ink fill port configured to accept the ink to be injected into the container body, and the cap provided to close the ink fill port when the cap is attached to the tank. The cap comprises a covering portion configured to cover the ink fill port; and a grip portion protruded from the covering portion toward an opposite side that is opposite to an ink fill port side. The grip portion comprises a sloped part that is sloped inward of an area of the covering portion from a covering portion side to an opposite end of the grip portion that is opposite to the covering portion side.

In the cap of this aspect, the grip portion includes the sloped part. This configuration allows for downsizing of the grip portion and thereby allows for downsizing of the cap.

(17) In the cap of the above aspect, the ink fill port may be inclined to a vertical direction in a use attitude of the tank. The sloped part may be sloped according to inclination of the ink fill port.

In the cap of this aspect, the sloped part is sloped according to inclination of the ink fill port. This configuration enables the sloped part to be readily arranged along the vertical direction when the cap is attached to the ink fill port.

(18) In the cap of the above aspect, the grip portion may comprise two sloped parts opposed to each other in a direction intersecting with a center axis of the cap; and two flat portions configured to connect the two sloped parts with each other and arranged opposite to each other to be approximately parallel to a center axis direction of the ink fill port when the cap is attached to the ink fill port.

The configuration of the cap of this aspect allows for downsizing of the cap, compared with a configuration that the sloped parts are not sloped but are extended in a direction parallel to the center axis of the cap.

(19) According to another aspect of the disclosure, there is provided a printer comprising a print head configured to eject an ink; a tank comprising a container body configured to contain the ink to be supplied to the print head and an ink fill port configured to accept the ink to be injected into the container body; a housing configured to cover at least part of a portion of the tank other than the ink fill port; a cover configured to be opened and closed relative to the housing and provided to make the ink fill port of the tank exposed when the cover is opened relative to the housing; and the cap having any of the above aspect. The cover includes an inner face extended along a vertical direction in a closed state of the cover. A gap is formed between the cap and the inner face when the cap is attached to the ink fill port such that the sloped part of the cap is opposed to the inner face of the cover in the closed state.

In the printer of this aspect, a gap is formed between the cap and the cover when the cover is closed to the housing in the state that the cap is attached to the ink fill port. This configuration suppresses the cap from coming into contact with the cover. This configuration accordingly enables the cover to be securely closed to the housing in the state that the cap is attached to the ink fill port.

(20) In the printer of the above aspect, the ink fill port may be inclined in a direction toward the inner face of the cover in the closed state. The cap may be attached to the ink fill port such that the sloped part of the cap is opposed to the inner face and that the sloped part is approximately parallel to the inner face of the cover in the closed state.

In the printer of this aspect, the sloped part of the cap is approximately parallel to the inner face of the cover in the state that the cap is attached to the ink fill port. This configuration suppresses the cap from coming into contact with the cover when the cover is closed to the housing in the state that the cap is attached to the ink fill port, while allowing for size expansion of the grip portion.

(21) In the printer of the above aspect, the sloped part of the cap may be formed such that an angle between a tangent of the sloped part and an axial line of a center axis of the cap is equal to or greater than an angle between a tangent at an end of the ink fill port and a horizontal line.

The configuration of the printer of this aspect suppresses the cap from coming into contact with the cover when the cover is closed in the state that the cap is attached to the ink fill port such that the sloped part faces the inner face of the cover, while allowing for size expansion of the grip portion.

(22) According to another aspect of the disclosure, there is provided a printer comprising a print head configured to eject an ink; a tank comprising a container body configured to contain the ink to be supplied to the print head and an ink fill port configured to accept the ink to be injected into the container body; a housing configured to cover at least part of a portion of the tank other than the ink fill port; and a receiving plate comprising a placement surface configured to receive a cap placed thereon, wherein the cap is configured to close the ink fill port when the cap is attached to the ink fill port of the tank. The placement surface may be inclined in a use attitude of the receiving plate. In the use attitude of the receiving plate, the cap may be inclined equivalently to inclination of the placement surface of the receiving plate when the cap is attached to the ink fill port.

In the printer of this aspect, the inclination of the cap attached to the ink fill port is equivalent to the inclination of the placement surface of the receiving plate. This configuration enables the cap to be moved to the receiving plate while maintaining the inclination of the cap, when the cap is removed from the ink fill port and is transferred to the receiving plate. As a result, this configuration facilitates the operation of removing the cap from the ink fill port and transferring the cap to the receiving plate. This accordingly enhances the convenience of the printer.

(23) According to another aspect of the disclosure, there is provided a printer comprising a print head configured to eject an ink; a tank comprising a container body configured to contain the ink to be supplied to the print head and an ink fill port configured to accept the ink to be injected into the container body; a cap configured to close the ink fill port; and a housing configured to cover at least part of a portion of the tank other than the ink fill port. The housing comprises an opening formed and defined to make the ink fill port exposed. A gap is formed between the cap and an edge of the housing. The edge of the housing defines the opening when the ink fill port is closed by the cap.

In the printer of this aspect, the ink fill port is exposed through the opening that is formed in the housing configured to cover at least part of the portion of the tank other than the ink fill port. In the printer of this aspect, a gap is formed between the cap and the opening when the cap is attached to the tank. This configuration enables the cap to pass through inside of the opening and thereby enables the housing to be dismounted from the printer, for example, in the state that the cap is attached to the cap.

(24) The printer of the above aspect may further comprise an absorber provided in a circumference of the ink fill port of the tank and configured to absorb the ink.

The configuration of this printer enables ink dripping off to the circumference of the ink fill port of the tank to be absorbed by the absorber.

DESCRIPTION OF EMBODIMENTS

The following describes some embodiments with reference to the drawings. In the respective drawings, different scales may be employed for respective configurations and components, in order to express the respective configurations in recognizable sizes.

Figure 1:
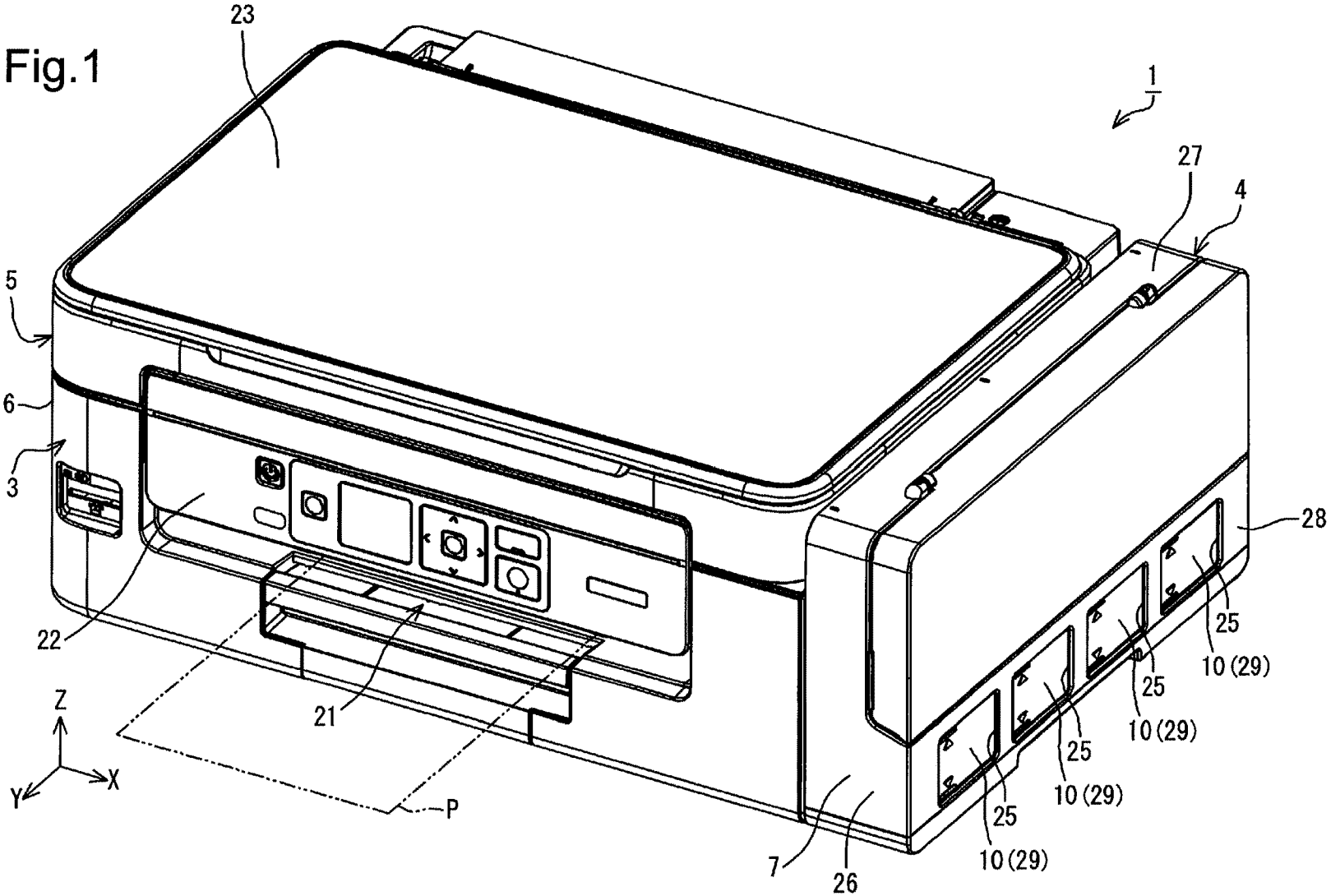
FIG. 1 is a perspective view illustrating the main configuration of a printer according to an embodiment.

As shown in FIG. 1, a printer 1 according to this embodiment includes a printing unit 3 as one example of the liquid ejection apparatus, a tank unit 4 placed on a lateral side of the printing unit 3, and a scanner unit 5. The printing unit 3 includes a housing 6. The housing 6 forms the outer shell of the printing unit 3. A mechanical unit (described later) of the printing unit 3 is placed inside of the housing 6. The tank unit 4 includes a housing 7 and a plurality of tanks 10, i.e. two or more than two tanks 10. According to this embodiment, four tanks 10 are provided. The housing 6, the housing 7 and the scanner unit 5 form the outer shell of the printer 1. According to another embodiment, the printer 1 may be configured with omission of the scanner unit 5. The printer 1 is configured to perform printing with ink on a printing medium P such as printing paper. The printing medium P is one example of the medium on which printing is performed.

XYZ axes that are coordinate axes orthogonal to one another are shown in FIG. 1. XYZ axes are also shown in subsequent drawings as needed. In this case, the XYZ axes shown in the respective drawings correspond to the XYZ axes shown in FIG. 1. FIG. 1 illustrates the printer 1 that is placed on an XY plane defined by the X axis and the Y axis. According to this embodiment, the state that the printer 1 is placed on the XY plane such that the XY plane corresponds to a horizontal plane is the use stated of the printer 1. The attitude of the printer 1 that is placed on the XY plane corresponding to the horizontal plane is called the use attitude of the printer 1.

In the description below, the X axis, the Y axis and the Z axis expressed in the illustration or in the description of a component or a unit of the printer 1 means the X axis, the Y axis and the Z axis in the state that the component or the unit is incorporated in (mounted on) the printer 1. The attitude of each component or unit in the use attitude of the printer 1 is called the use attitude of the component or unit. The following description of the printer 1 or its component, unit or the like is assumed to be the description in the use attitude thereof, unless otherwise specified.

The Z axis is an axis that is orthogonal to the XY plane. In the use state of the printer 1, a Z-axis direction denotes a vertically upward direction. In the use state of the printer 1, a −Z-axis direction denotes a vertically downward direction in FIG. 1. With respect to each of the XYZ axes, the direction of an arrow indicates a + (positive) direction, and an opposite direction opposite to the direction of the arrow indicates a − (negative) direction. The four tanks 10 described above are arrayed along the Y axis. AY-axis direction may thus be defined as the direction of the array of the four tanks 10.

The printing unit 3 includes a paper eject portion 21. The printing medium P is ejected from the paper eject portion 21 in the printing unit 3. A face of the printing unit 3 provided with the paper eject portion 21 is specified as a front face 22. The front face 22 of the printing unit 3 and a front face 22 of the scanner unit 5 are on the same plane. In other words, a front face 22 of the printer 1 includes the front face 22 of the printing unit 3 and the front face 22 of the scanner unit 5.

In the printer 1, a vertically upward face of the scanner unit 5 is specified as a top face 23. The tank unit 4 is provided on a side portion that faces in an X-axis direction out of the lateral side that intersects with the front face 22 and the top face 23. Windows 25 are provided in the housing 7. The windows 25 are provided in a lateral side 28 that intersects with a front face 26 and a top face 27 of the housing 7. The front face 26 of the tank unit 4 faces in the same direction, which is Y-axis direction according to this embodiment, as that of the front face 22 of the printer 1. The front face 26 of the tank unit 4 and the front face 22 of the printer 1 are flush with each other. In other words, the front face 26 of the tank unit 4 and the front face 22 of the printing unit 3 are flush with each other. This configuration reduces the irregularity between the printing unit 3 and the tank unit 4 in the appearance of the printer 1 and thereby reduces the possibility that the printer 1 bumps into the surrounding environment while the printer 1 is transferred.

In the tank unit 4, the windows 25 have light permeability. The four tanks 10 described above are provided at positions overlapping with the windows 25. Each tank 10 includes a container body 29. In the tank 10, ink is contained in the container body 29. The window 25 is provided at a position overlapping with the container body 29 in the tank 10. This configuration enables an operator using the printer 1 to observe the container bodies 29 of the four tanks 10 via the windows 25 across the housing 7. According to this embodiment, the windows 25 are provided as opening formed in the housing 7. The operator can visually check the four tanks 10 via the windows 25 that are the openings. The windows 25 are, however, not limited to the openings but may be configured by members having light permeability.

According to this embodiment, at least part of the wall of the container body 29 facing the window 25 of each tank 10 has light permeability. Ink contained in the container body 29 is visible from a light-permeable portion of each container body 29. The operator observes the four tanks 10 via the windows 25, so as to visually check the amounts of inks contained in the container bodies 29 of the respective tanks 10. Accordingly, at least part of a portion facing the window 25 in the tank 10 may be used as the visible portion that allows the amount of ink to be visually checked. The operator can thus observe the visible portions of the four tanks 10 via the windows 25 across the housing 7.

Figure 2:
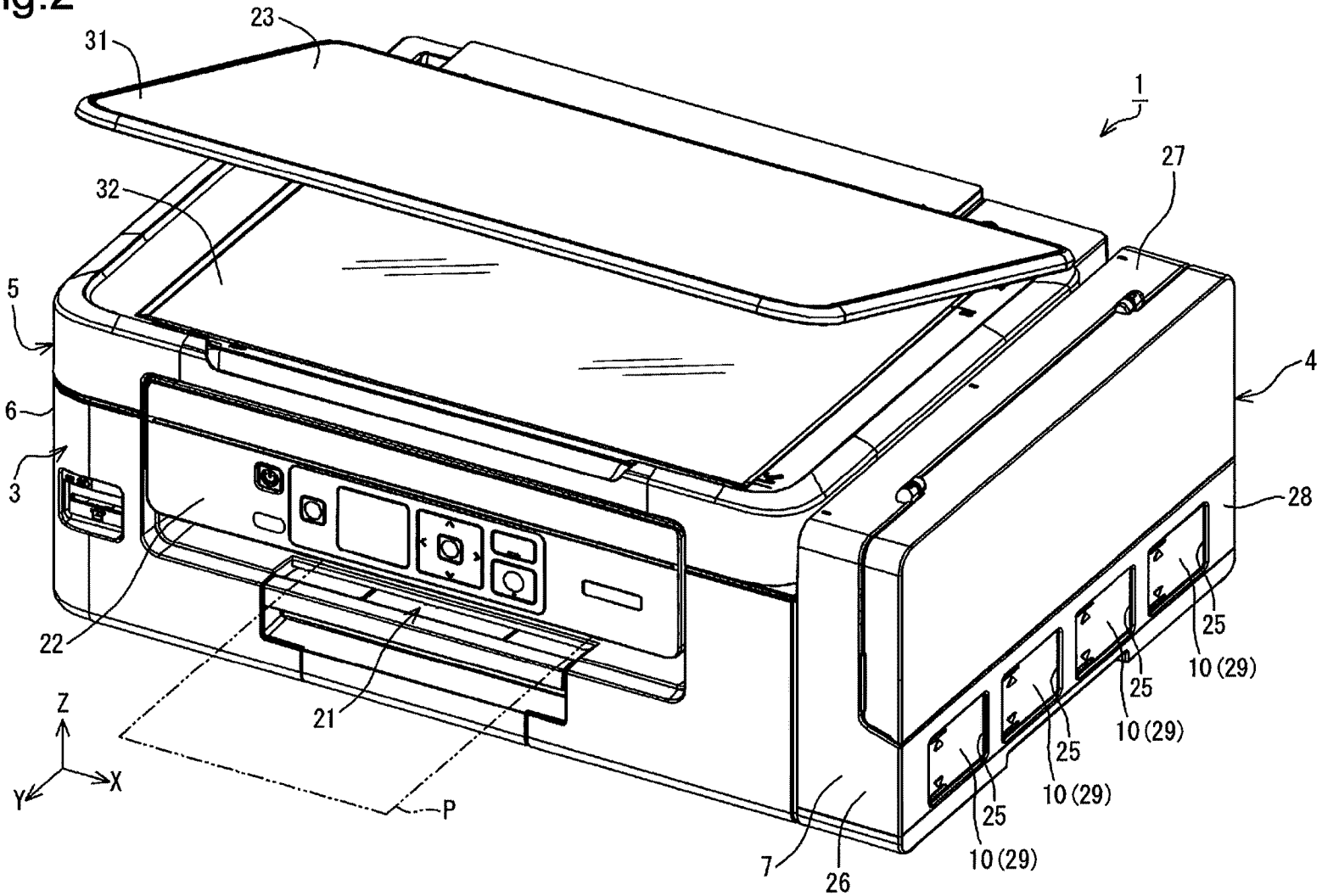
FIG. 2 is a perspective view illustrating the main configuration of the printer according to the embodiment.

In the printer 1, the printing unit 3 and the scanner unit 5 are stacked with each other. In the use state of the printing unit 3, the scanner unit 5 is located vertically above the printing unit 3. The scanner unit 5 is a flat-bed type and includes an original cover 31 that is configured to be rotated in an openable and closable manner and an original placement surface 32 that is exposed when the original cover 31 is opened as shown in FIG. 2. FIG. 2 illustrates the state that the original cover 31 is opened. The scanner unit 5 includes an imaging element such as an image sensor (not shown). The scanner unit 5 is configured to read an image drawn on an original such as a sheet of paper placed on the original placement surface 32, via the imaging element as image data. The scanner unit 5 thus serves as a reading device of images and the like.

Figure 3:
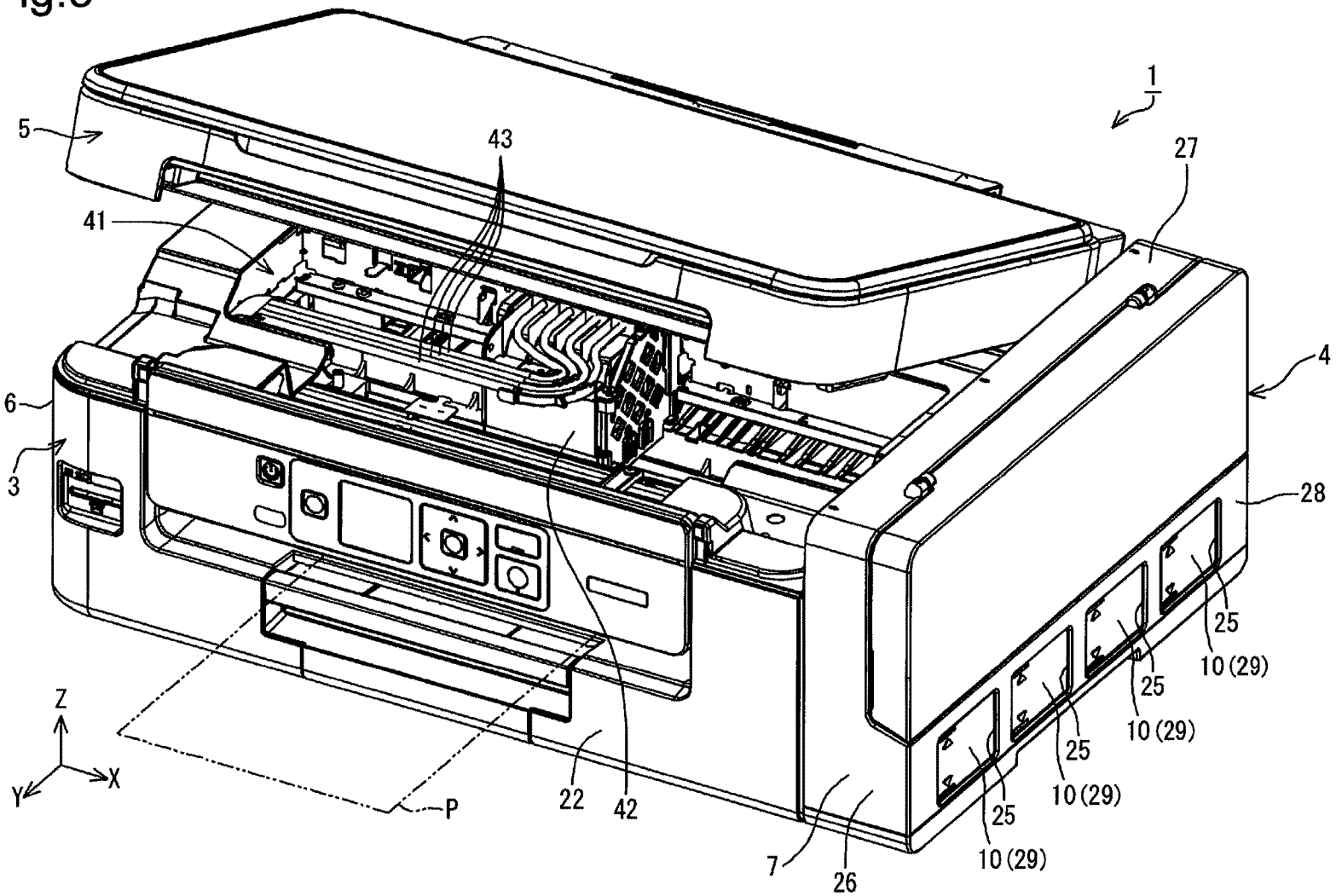
FIG. 3 is a perspective view illustrating the main configuration of the printer according to the embodiment.

As shown in FIG. 3, the scanner unit 5 is configured to be rotatable relative to the printing unit 3. The scanner unit 5 also serves as a cover of the printing unit 3. The operator lifts up the scanner unit 5 in the Z-axis direction to rotate the scanner unit 5 relative to the printing unit 3. The scanner unit 5 serving as the cover of the printing unit 3 is thus opened relative to the printing unit 3. FIG. 3 illustrates the state that the scanner unit 5 is opened relative to the printing unit 3.

As shown in FIG. 3, the printing unit 3 includes a mechanical unit 41. The mechanical unit 41 includes a printing portion 42. In the printing unit 3, the printing portion 42 is placed in the housing 6. The printing portion 42 performs printing with ink on the printing medium P that is fed in the Y-axis direction by a feeding device which is not shown in figures. The non-illustrated feeding device is configured to intermittently feed the printing medium P in the Y-axis direction. The printing portion 42 is configured to be movable back and forth along the X axis by a moving device which is not shown in the figures. The tank unit 4 is configured to supply ink to the printing portion 42. In the printer 1, at least part of the tank unit 4 is protruded outside of the housing 6. The printing portion 42 is placed in the housing 6. This configuration enables the printing portion 42 to be protected by the housing 6.

A direction along the X axis herein is not limited to a direction completely parallel to the X axis but includes directions deviated by some error, tolerance or the like except a direction perpendicular to the X axis. Similarly a direction along the Y axis is not limited to a direction completely parallel to the Y axis but includes directions deviated by some error, tolerance or the like except a direction perpendicular to the Y axis. A direction along the Z axis is not limited to a direction completely parallel to the Z axis but includes directions deviated by some error, tolerance or the like except a direction perpendicular to the Z axis. In general, a direction along an arbitrary axis or plane is not limited to a direction completely parallel to the arbitrary axis or plane but includes directions deviated by some error, tolerance or the like except a direction perpendicular to the arbitrary axis or plane.

The tank unit 4 includes the tanks 10. According to this embodiment, the tank unit 4 includes a plurality of tanks 10. In this embodiment, the tank unit 4 includes four tanks 10 as one example. The plurality of tanks 10 are located outside of the housing 6 of the printing unit 3. The plurality of tanks 10 are placed inside of the housing 7. This configuration enables the tanks 10 to be protected by the housing 7. The housing 7 is located outside of the housing 6. The housing 7 is fixed to the housing 6 with screws. In other words, the tank unit 4 is fixed to the printing unit 3 with screws.

According to this embodiment, the tank unit 4 includes four tanks 10 as a plurality of tanks 10. The number of the tanks 10 is, however, not limited to four but may be three, may be a number less than three or may be a number greater than four.

Additionally, according to this embodiment, the plurality of tanks 10 are configured as separate bodies. The configuration of the tanks 10 as one example of the liquid container is, however, not limited to this embodiment. According to another configuration of the liquid container, the plurality of tanks 10 may be integrated to one liquid container. In this case, a plurality of liquid containing bodies are provided in one liquid container. The plurality of liquid containing bodies are parted from one another and configured to contain different types of liquids. In this case, for example, different colors of inks may be respectively contained in the plurality of liquid containing bodies.

Each tank 10 is connected with an ink supply tube 43 as shown in FIG. 3. Ink contained in the tank 10 is supplied from the tank unit 4 through the ink supply tube 43 to the printing portion 42. The printing portion 42 includes a print head which is not shown in figures. Nozzle openings arranged to face the printing medium P-side are formed in the print head. The nozzle openings are not shown in figures. The print head is an inkjet-type print head. The ink supplied from the tank unit 4 through the ink supply tube 43 to the printing portion 42 is supplied to the print head. The ink supplied to the print head is ejected from the nozzle openings of the print head toward the printing medium P in the form of ink droplets.

According to this embodiment, the printing unit 3 and the tank unit 4 are provided as separate components. In other words, the housing 7 and the housing 6 are separate bodies according to this embodiment. According to another configuration, however, the housing 7 and the housing 6 may be integrated with each other. The tank unit 4 may thus be configured to be included in the printing unit 3. In the configuration that the housing 7 and the housing 6 are integrated with each other, along with the printing portion 42 and the ink supply tubes 43, the plurality of tanks 10 are placed inside of the housing 6.

The location where the tanks 10 are placed is not limited to the lateral side in the X-axis direction of the housing 6. The location where the tanks 10 are placed may be, for example, a front face side in the Y-axis direction of the housing 6.

The printer 1, which is configured as described above, performs printing on the printing medium P by feeding the printing medium P in the Y-axis direction, moving back and forth the printing portion 42 along the X-axis, and ejecting ink from the print head of the printing portion 42 arrived to a predetermined position.

Ink is not limited to either one of a water-based ink and an oil-based ink. The water-based ink may be configured by dissolving a solute such as a dye in an aqueous solvent or may be configured by dispersing a dispersoid such as a pigment in an aqueous dispersion medium. The oil-based ink may be configured by dissolving a solute such as a dye in an oil solvent or may be configured by dispersing a dispersoid such as a pigment in an oil dispersion medium.

Figure 4:
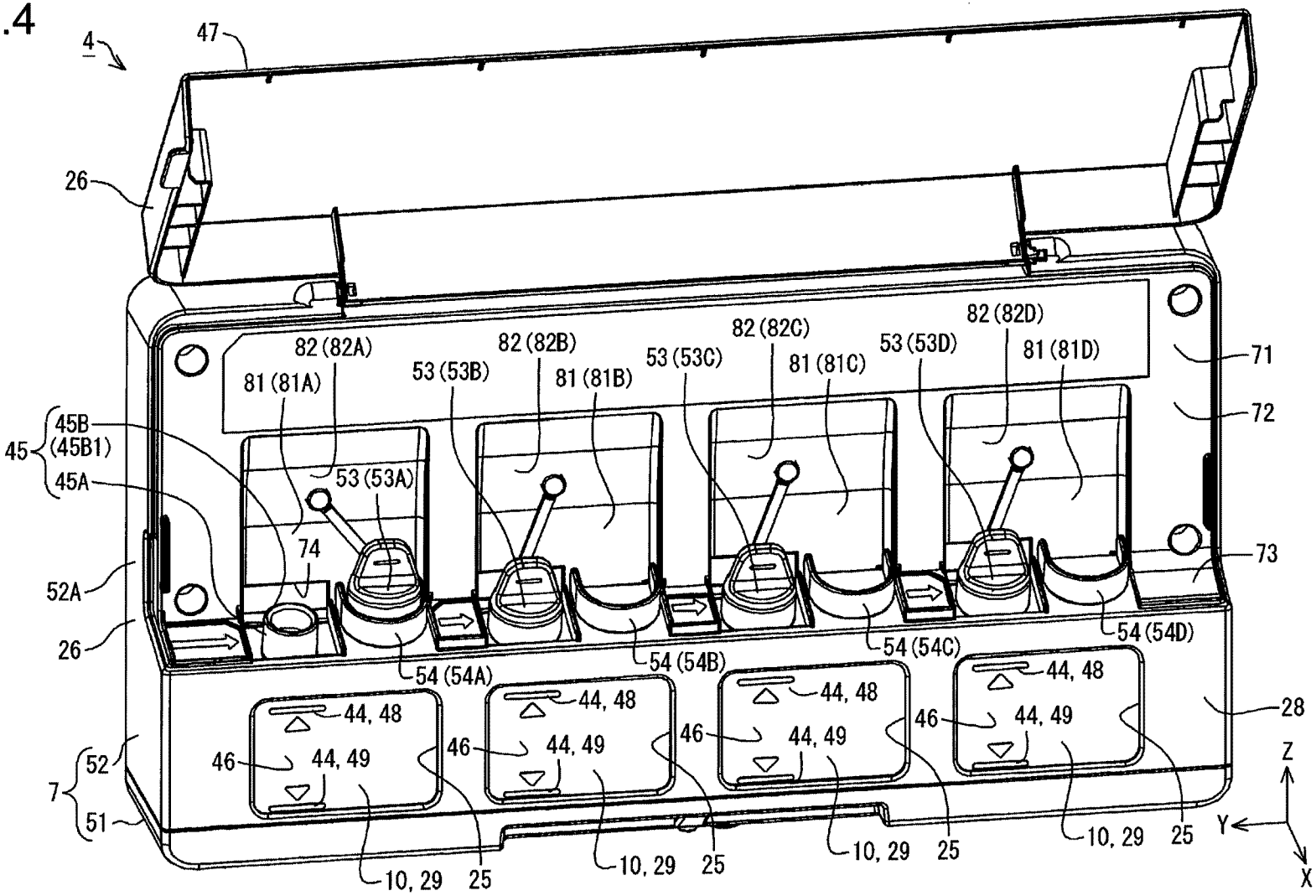
FIG. 4 is a perspective view illustrating a tank unit according to the embodiment.

In the tank unit 4, a marker 44 is provided on the tank 10 as shown in FIG. 4. The tank 10 includes an injection portion 45 and a visible plane 46 as one example of the visible portion described above. The tank 10 is configured to enable ink to be injected from outside of the tank 10 to inside of the tank 10 via the injection portion 45. The injection portion 45 is connected with the container body 29 of the tank 10. The injection portion 45 includes a cylinder portion 45A and an ink fill port 45B. The cylinder portion 45 has a cylindrical structure and is protruded upward from the tank 10. The ink fill port 45B is an opening located at an upper end of the cylinder portion 45A. The ink fill port 45B is open upward. The operator opens a cover 47 of the housing 7 to make the injection portion 45 of the tank 10 accessible from outside of the housing 7. The cover 47 is configured to be rotatable relative to a main body 52A via a hinge.

The visible plane 46 is arranged to face the window 25. The operator observes the visible plane 46 of the tank 10 via the window 25, so as to visually check the amount of ink contained in the container body 29 of each tank 10. The amount of ink contained in each tank 10 is one piece of information with regard to ink. The marker 44 indicates information with regard to ink. According to this embodiment, the marker 44 is provided on the visible plane 46 of the tank 10.

For example, an upper limit mark 48 and a lower limit mark 49 may be provided as the marker 44 indicating the information with regard to ink. According to this embodiment, the upper limit mark 48 and the lower limit mark 49 are provided on the visible plane 46 of the tank 10. The operator may check the amount of ink contained in the tank 10 using the upper limit mark 48 and the lower limit mark 49 as guides. The upper limit mark 48 is an indication of the amount of ink that suppresses ink injected from the injection portion 45 from overflowing from the injection portion 45. The lower limit mark 49 is an indication of the amount of ink that encourages injection of ink. According to another configuration, at least one of the upper limit marks 48 and the lower limit mark 49 may be provided on the tank 10.

The marker 44 indicating the information with regard to ink may be constituted by a scale indicating the amount of ink contained in each tank 10. The marker 44 may be configured to include a scale in addition to the upper limit mark 48 and the lower limit mark 49 or may be configured to include a scale with omission of the upper limit mark 48 and the lower limit mark 49. The marker 44 indicating the information with regard to ink may be constituted by a mark indicating the type of ink contained in each tank 10. For example, the marker 44 may be configured to indicate the color of ink as the type of ink. A variety of indications, for example, letters such as "Bk" indicating black ink, "C" indicating cyan ink, "M" indicating magenta ink and "Y" indicating yellow ink or color indications, may be employed as the marker 44 indicating the color of ink.

As shown in FIG. 4, the housing 7 includes a first housing 51 and a second housing 52. The first housing 51 is located on the −Z-axis direction side of the plurality of tanks 10. The second housing 52 is located on the Z-axis direction side of the first housing 51 to cover the plurality of tanks 10 from the Z-axis direction side of the first housing 51. The plurality of tanks 10 are covered by the first housing 51 and the second housing 52. The second housing 52 includes the main body 52A and the cover 47. The main body 52A is configured to cover at least part of the tanks 10 other than the injection portions 45. The main body 52A is one example of housing. The cover 47 is located at an end in the X-axis direction of the second housing 52. The cover 47 forms part of the lateral side 28 that faces in the X-axis direction. The cover 47 is configured to be rotatable relative to the main body 52A of the second housing 52 as shown in FIG. 4.

When the cover 47 is opened relative to the main body 52A of the second housing 52, the injection portions 45 of the plurality of tanks 10 are exposed. This makes the injection portion 45 of the tank 10 accessible from outside of the housing 7 for the operator. The ink fill port 45B is sealed with a cap 53. In the process of injecting ink into the tank 10, ink is injected after the ink fill port 45B is opened by removing the cap 53 from the injection portion 45. In the use attitude of the printer 1, the ink fill port 45B faces upward relative to the horizontal direction.

The cap 53 is provided for each ink fill port 45B. In other words, according to this embodiment, the number of the caps 53 is same as the number of the ink fill ports 45B. In this embodiment, the number of the caps 53 is four as one of example. In the description below, when there is a need to distinguish the four caps 53 from one another, the four caps 53 are expressed respectively as cap 53A, cap 53B, cap 53C and cap 53D. The cap 53 is attachable to and detachable from the main body 52A and is not an essential component in the printer 1 according to this embodiment.

In the tank unit 4, the main body 52A is provided with receiving plate s 54. The cap 53 removed from the injection portion 45 may be placed on the receiving plate 54. According to this embodiment, the receiving plate 54 is provided with a view to allowing the cap 53 removed from the injection portion 45 to be placed on the receiving plate 54. The receiving plate 54 is provided for each ink fill port 45B. In other words, according to this embodiment, the number of the receiving plates 54 is same as the number of the number of the ink fill ports 45B. In this embodiment, The number of the receiving plates 54 is four as one of example. The plurality of ink fill ports 45B, i.e. four ink fill ports 45B in this embodiment, are arrayed along the Y axis. The plurality of receiving plates 54, i.e. four receiving plates 54 in this embodiment, are also arrayed along the Y axis.

In the description below, when there is a need to distinguish the four receiving plates 54 from one another, the four receiving plates 54 are expressed respectively as receiving plate 54A, receiving plate 54B, receiving plate 54C and receiving plate 54D. In the description below, when there is a need to distinguish the four ink fill ports 45B from one another, the four ink fill ports 45B are expressed respectively as ink fill port 45B1, ink fill port 45B2, ink fill port 45B3 and ink fill port 45B4. Among the four ink fill ports 45B, the ink fill port 45B1 is located on the most Y-axis direction side. In other words, the four ink fill ports 45B are arranged in the sequence of the ink fill port 45B4, the ink fill port 45B3, the ink fill port 45B2 and the ink fill port 45B1 from the −Y-axis direction side toward the Y-axis direction side.

The receiving plate 54A and the cap 53A are provided corresponding to the ink fill port 45B1. The receiving plate 54B and the cap 53B are provided corresponding to the ink fill port 45B2. The receiving plate 54C and the cap 53C are provided corresponding to the ink fill port 45B3. The receiving plate 54D and the cap 53D are provided corresponding to the ink fill port 45B4.

As shown in FIG. 4, the main body 52A of the second housing 52 includes a covered portion 71. The covered portion 71 is a part covered by the cover 47 when the cover 47 is closed to the main body 52A. The covered portion 71 includes a wall 72 arranged to face in the X-axis direction and a wall 73 arranged to face in a direction intersecting with the wall 72. The wall 72 is located on the −X-axis direction side of the lateral side 28. The wall 73 is located on the −Z-axis direction side of the top face 27 shown in FIG. 3. Four openings 74 are formed in the covered portion 71. The four openings 74 are formed at the positions corresponding to the respective tanks 10. The opening 74 is formed across an intersection between the wall 72 and the wall 73 to be extended in the wall 72 and the wall 73. The injection portion 45 of the tank 10 is exposed from the main body 52A via the opening 74.

The covered portion 71 also includes recesses 81. The recess 81 is formed in the wall 72 to be concave in the −X-axis direction. The recess 81 is provided for each ink fill port 45B. In the description below, when there is a need to distinguish the four recesses 81 from one another, the four recesses 81 are expressed respectively as recess 81A, recess 81B, recess 81C and recess 81D. The recess 81A is provided corresponding to the ink fill port 45B1. The recess 81B is provided corresponding to the ink fill port 45B2. The recess 81C is provided corresponding to the ink fill port 45B3. The recess 81D is provided corresponding to the ink fill port 45B4. The recess 81 is arranged to be overlapped with the ink fill port 45B and the receiving plate 54 when the main body 52A is viewed from the front side, i.e., when the main body 52A is viewed in the −X-axis direction. In other words, each corresponding set of the ink fill port 45B and the receiving plate 54 is located in an area overlapping with each corresponding recess 81 when the main body 52A is viewed from the front side.

An inclined wall 82 is provided in each recess 81. Accordingly, four inclined walls 82 are provided in the main body 52A that includes the four recesses 81. The inclined wall 82 is inclined to the wall 72. According to this embodiment, the wall 72 is extended along a YZ plane. The inclined wall 82 is accordingly inclined to the YZ plane. The inclined wall 82 is inclined toward the −Z-axis is direction side from the upper side to the lower side, i.e., from the Z-axis direction side to the −Z-axis direction side. In other words, the inclined wall 82 is inclined inward of the housing 7 from the upper side to the lower side, i.e., toward the printing unit 3 shown in FIG. 3 from the upper side to the lower side.

In the description below, when there is a need to distinguish the four inclined walls 82 from one another, the four inclined walls 82 are expressed respectively as inclined wall 82A, inclined wall 82B, inclined wall 82C and inclined wall 82D. The inclined wall 82A is provided corresponding to the ink fill port 45B1. The inclined wall 82B is provided corresponding to the ink fill port 45B2. The inclined wall 82C is provided corresponding to the ink fill port 45B3. The inclined wall 82D is provided corresponding to the ink fill port 45B4. The wall 72 of the main body 52A is provided corresponding to a side wall having the inclined wall 82.

Figure 5:
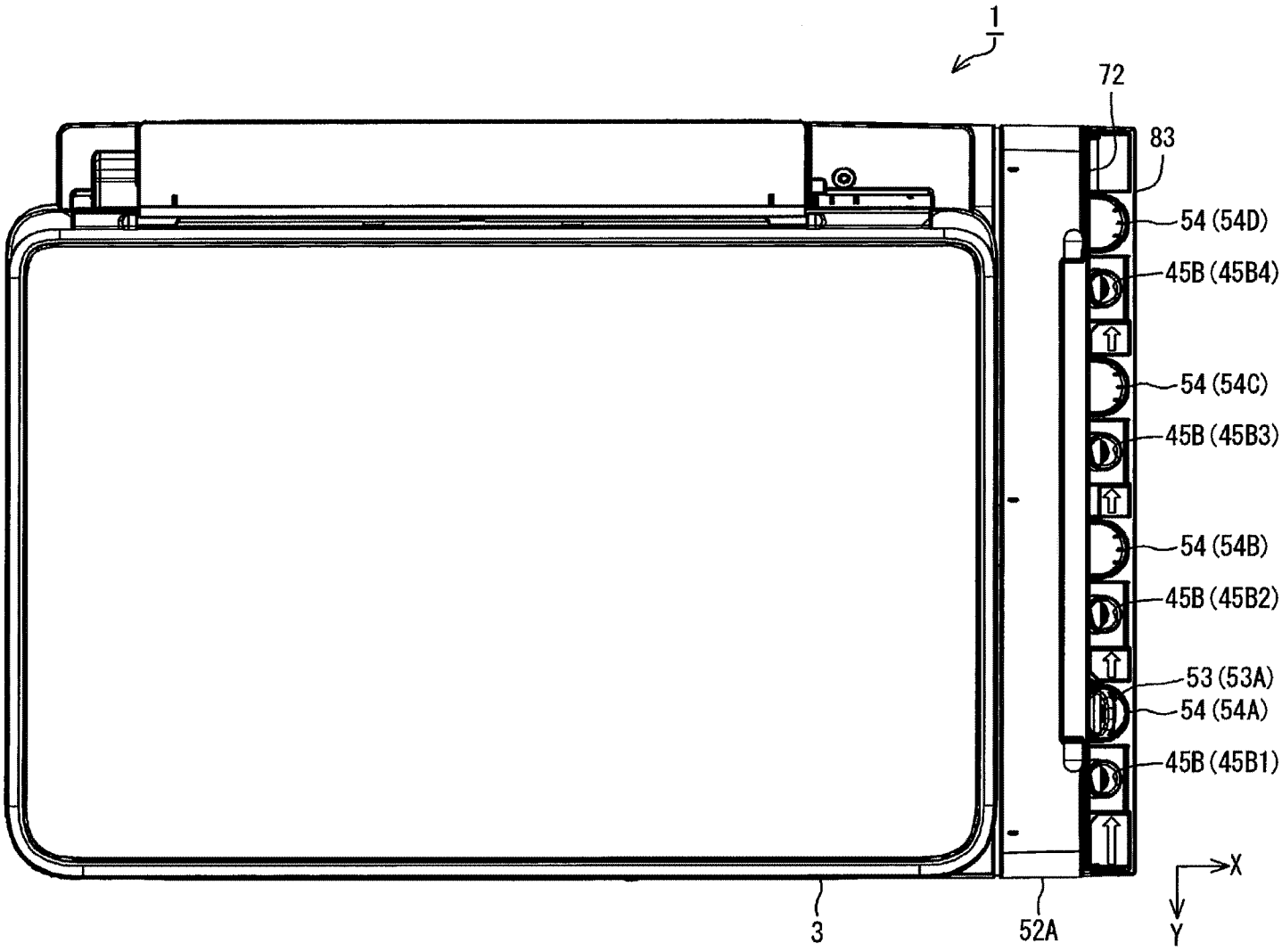
FIG. 5 is a plan view illustrating the main configuration of the printer according to the embodiment.

When the printer 1 is viewed from the Z-axis direction side in the use attitude of the printer 1, the receiving plate 54 and the ink fill port 45B are arrayed in a first direction that is along one side 83 of the printer 1 as shown in FIG. 5. According to this embodiment, the first direction along one side 83 of the printer 1 corresponds to the Y-axis direction. As shown in FIG. 5, the four ink fill ports 45B are located in the area of the printer 1. More specifically, the four ink fill ports 45B are located on the −X-axis direction side of one side 83 of the printer 1, i.e., on the printing unit 3-side of one side 83.

In FIG. 5, a direction from one side 83 toward the ink fill ports 45B that intersects with the first direction along one side 83 is defined as a second direction. The wall 72 of the main body 52A is located at a position on the second direction side of one side 83. According to this embodiment, the second direction from one side 83 toward the ink fill ports 45B that intersects with the first direction along one side 83 corresponds to the −X-axis direction. The side wall located on the second direction side of the ink fill ports 45B corresponds to the wall 72 of the main body 52A.

Figure 6:
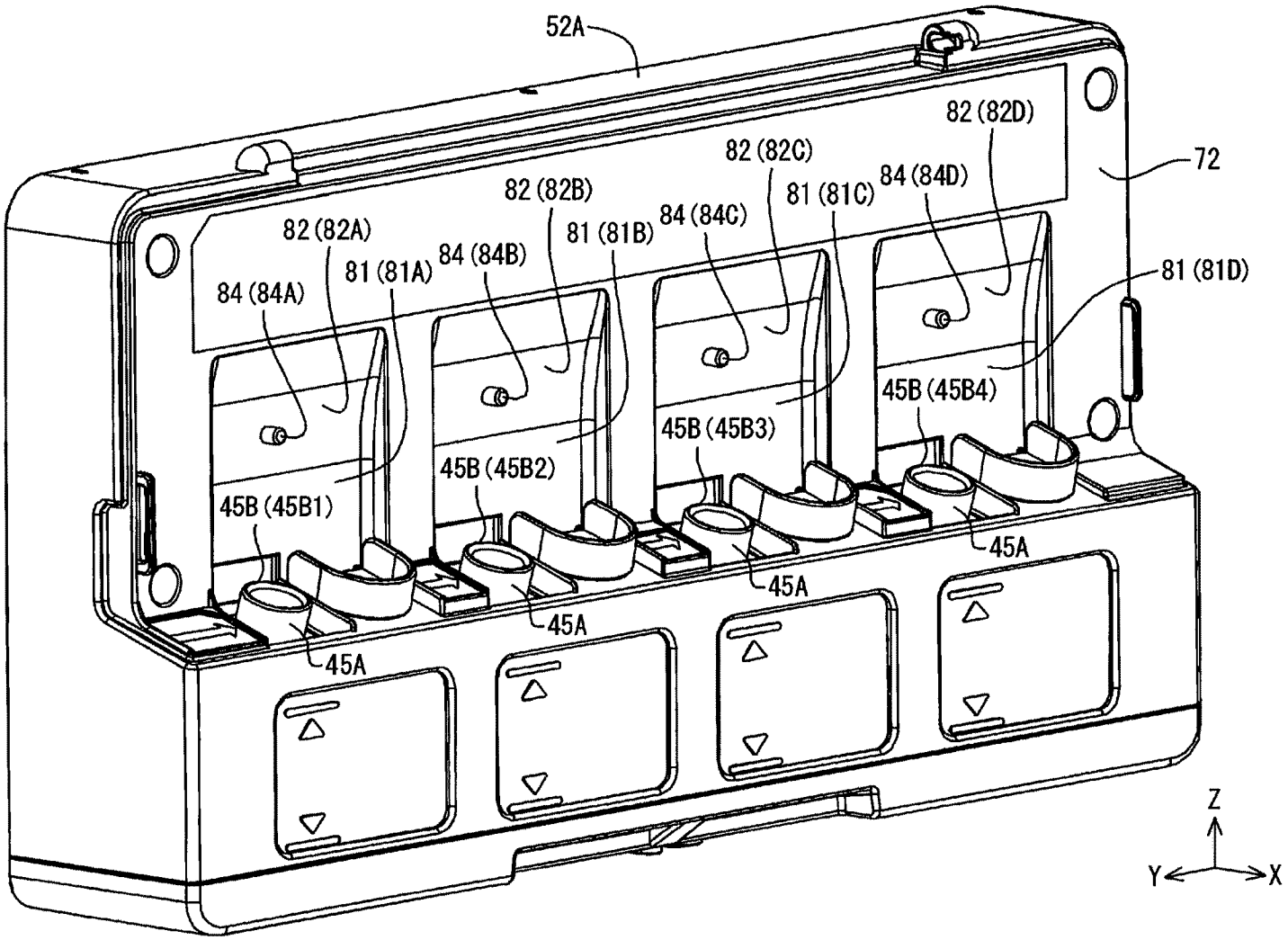
FIG. 6 is a perspective view illustrating part of the tank unit according to the embodiment.

As shown in FIG. 6, the main body 52A is provided with connecting portions 84. An anchor portion (described later) provided in the cap 53 shown in FIG. 4 is connected with the connecting portion 84. The connecting portion 84 is provided for each ink fill port 45B. Four connecting portions 84 are thus provided according to this embodiment. In the description below, when there is a need to distinguish the four connecting portions 84 from one another, the four connecting portions 84 are expressed respectively as connecting portion 84A, connecting portion 84B, connecting portion 84C and connecting portion 84D. The connecting portion 84A is provided corresponding to the ink fill port 45B1. The connecting portion 84B is provided corresponding to the ink fill port 45B2. The connecting portion 84C is provided corresponding to the ink fill port 45B3. The connecting portion 84D is provided corresponding to the ink fill port 45B4.

In the main body 52A, the connecting portion 84 is provided in the recess 81. The connecting portion 84 is formed as a projection that is protruded from the recess 81 in the X-axis direction. According to this embodiment, the amount of protrusion of the connecting portion 84 in the X-axis direction is within the depth of the recess 81. The connecting portion 84 is thus not protruded from the depth of the recess 81. The connecting portion 84 is provided on the inclined wall 82 in the recess 81. In other words, the connecting portion 84 is protruded from the inclined wall 82 in the X-axis direction according to this embodiment. The inclined wall 82 is not limited to a flat surface but may be a surface including irregularities or a curved surface.

Figure 7:
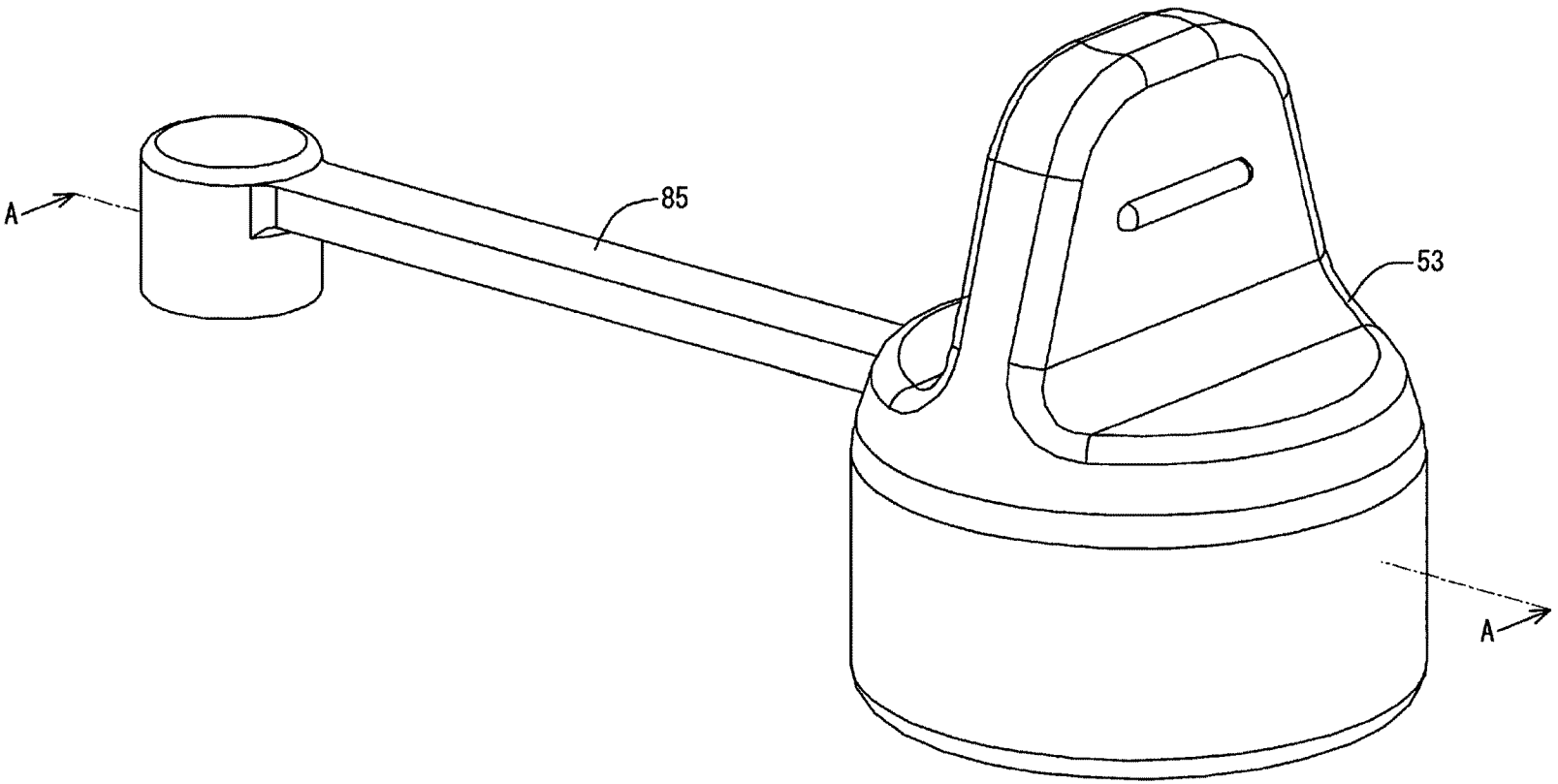
FIG. 7 is a perspective view illustrating a cap according to the embodiment.
Figure 8:
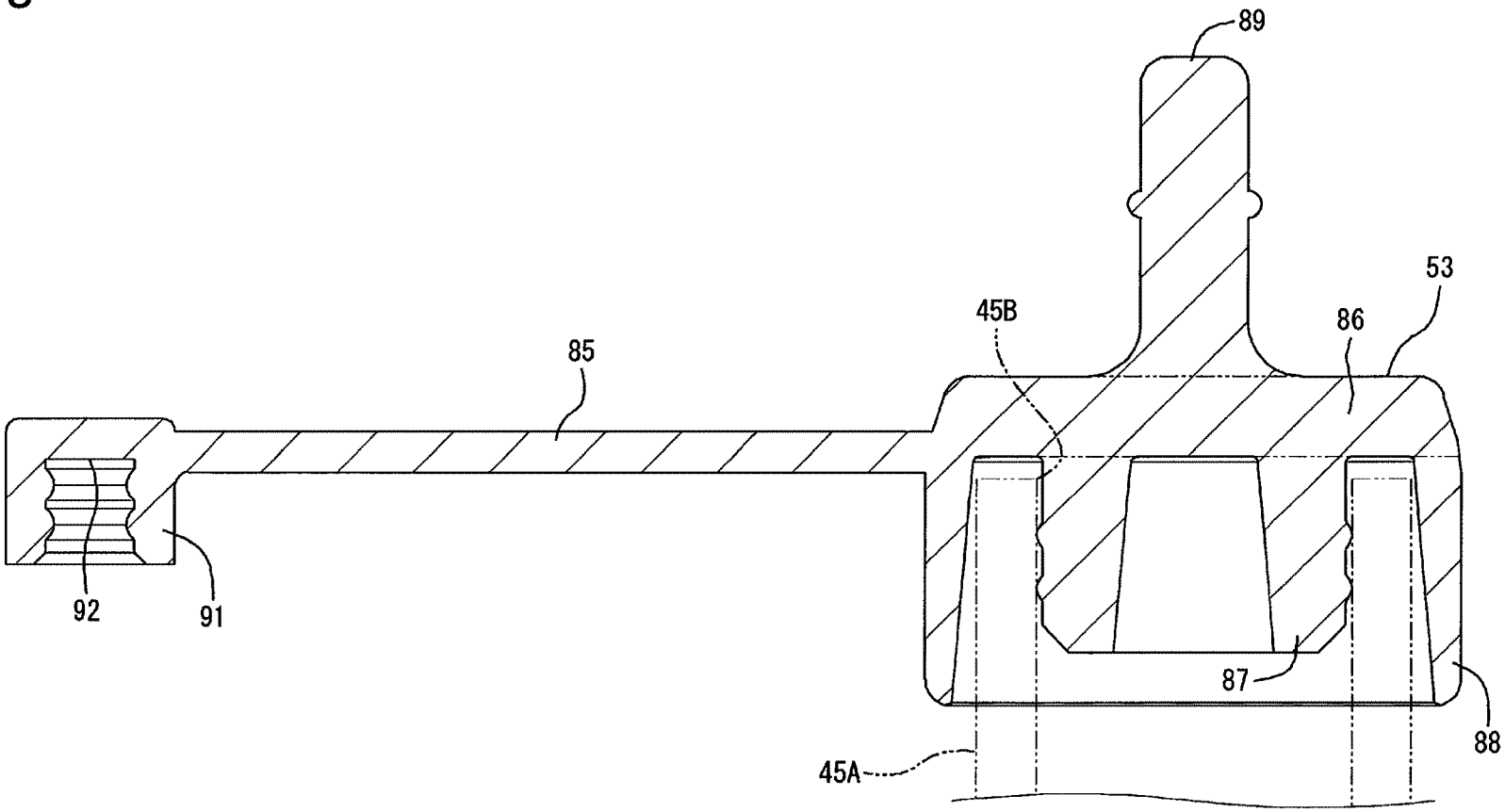
FIG. 8 is a sectional view taken on a line A-A in FIG. 7.

As shown in FIG. 7, an anchor portion 85 is provided in the cap 53. The cap 53 includes a covering portion 86, a seal portion 87, a skirt portion 88 and a grip portion 89 as shown in FIG. 8 that is a sectional view taken along a line A-A in FIG. 7. The cap 53 is made of a material that has high flexibility and high elasticity and is unlikely to allow for transmission of liquids and gases. For example, a rubber or an elastomer may be employed as the material of the cap 53.

The covering portion 86 is formed in such dimensions and a shape to cover the ink fill port 45B downward. According to this embodiment, the covering portion 86 forms a plate-like portion configured to cover the ink fill port 45B downward. The seal portion 87 is protruded from the covering portion 86. According to this embodiment, the seal portion 87 is protruded in a cylindrical shape from the covering portion 86 to be hollow inside thereof. The seal portion 87 is configured to be inserted into the ink fill port 45B and close the ink fill port 45B when the seal portion 87 is inserted in the ink fill port 45B. The seal portion 87 and the ink fill port 45B form an interference fit. More specifically, the seal portion 87 is press-fit into the ink fill port 45B, so as to close the ink fill port 45B. This configuration enhances the air tightness between the ink fill port 45B and the seal portion 87 when the cap 53 closes the ink fill port 45B.

In the description below, the state that the seal portion 87 is inserted into the ink fill port 45B to close the ink fill port 45B may be expressed as the state that the cap 53 is attached to the injection portion 45. In the description below, the state that the cap 53 is attached to the injection portion 45 means the state that the seal portion 87 is inserted into the ink fill port 45B to close the ink fill port 45B, unless otherwise specified. When the ink fill port 45B is closed with the cap 53, the seal portion 87 is inserted in the ink fill port 45B. Ink contained in the tank 10 or ink adhering to the cylinder portion 45A may thus adhere to the seal portion 87.

The skirt portion 88 is protruded from the covering portion 86 and located away from the seal portion 87 when the covering portion 86 is viewed from the seal portion 87-side. The direction in which the skirt portion 88 is protruded from the covering portion 86 is same as the direction in which the seal portion 87 is protruded from the covering portion 86. The amount of protrusion of the skirt portion 88 from the covering portion 86 is greater than the amount of protrusion of the seal portion 87 from the covering portion 86. In other words, the skirt portion 88 is protruded more than the seal portion 87. Even when ink is splattered from the seal portion 87, for example, by the momentum of pulling out the cap 53 with the ink-adhering seal portion 87 from the ink fill port 45B, the skirt portion 88 serves to trap the splattered ink. This configuration accordingly enhances the convenience of the cap 53.

According to this embodiment, when the covering portion 86 is viewed from the seal portion 87-side, the skirt portion 88 is provided around a circumferential area surrounding the seal portion 87. The configuration that the skirt portion 88 is protruded more than the seal portion 87 around the entire circumferential area surrounding the seal portion 87 is, however, not essential, but the skirt portion 88 may be configured to be partly cut out. This latter configuration also provides the effect of suppressing splatter of ink.

When the seal portion 87 is inserted into the ink fill port 45B, the cylinder portion 45A is located between the seal portion 87 and the skirt portion 88. In other words, when the seal portion 87 is inserted into the ink fill port 45B, the cylinder portion 45A is placed between the seal portion 87 and the skirt portion 88. The skirt portion 88 and the cylinder portion 45A may form an interference fit or may form a clearance fit. More specifically, the skirt portion 88 may be configured so that the cylinder portion 45A is press-fit into or may be configured to form a clearance between the skirt portion 88 and the cylinder portion 45A when the seal portion 87 is inserted into the ink fill port 45B.

The grip portion 89 is provided on an opposite side of the covering portion 86 that is opposite to the seal portion 87-side. The grip portion 89 is protruded from the covering portion 86 toward the opposite side to the seal portion 87-side. The operator holds the grip portion 89 to attach and detach the cap 53 to and from the injection portion 45.

The anchor portion 85 is extended in a bar-like shape from the covering portion 86. The anchor portion 85 is extended in a direction intersecting with the direction in which the seal portion 87 is protruded from the covering portion 86. A connected portion 91 is provided at an opposite end of the anchor portion 85 that is on the opposite side to the covering portion 86-side. The connected portion 91 is protruded in a cylindrical shape from the anchor portion 85. According to this embodiment, the direction in which the connected portion 91 is protruded from the anchor portion 85 is same as the direction in which the seal portion 87 is protruded from the covering portion 86. A recess 92 is formed inside of the connected portion 91 that is protruded in the cylindrical shape.

The connecting portion 84 of the main body 52A shown in FIG. 6 is inserted into the recess 92 of the connected portion 91, so that the anchor portion 85 is anchored to the connecting portion 84 of the main body 52A. According to this embodiment, the recess 92 and the connecting portion 84 form an interference fit. More specifically, the connecting portion 84 is press-fit into the recess 92, so as to connect the connected portion 91 with the connecting portion 84. This configuration enhances the fixation force of the connected portion 91 to the connecting portion 84. The cap 53 is thus less likely to come off from the main body 52A when the anchor portion 85 is anchored to the connecting portion 84.

As described above, according to this embodiment, the connecting portion 84 is provided on the inclined wall 82 in the recess 81. This configuration suppresses the anchor portion 85 from being protruded in the X-axis direction from the wall 72 of the main body 52A when the anchor portion 85 of the cap 53 is anchored to the connecting portion 84.

According to this embodiment, the cap 53 may be attached to the injection portion 45 in the state that the anchor portion 85 is anchored to the connecting portion 84 as shown in FIG. 4. The cap 53 removed from the injection portion 45 may be placed on the receiving plate 54 in the state that the anchor portion 85 is anchored to the connecting portion 84. According to this embodiment, the anchor portion 85 is configured to have such a length that allows the cap 53 to be attached to the injection portion 45 and that allows the cap 53 removed from the injection portion 45 to be placed on the receiving plate 54 provided corresponding to the cap 53 in the state that the anchor portion 85 is anchored to the connecting portion 84.

Figure 9:
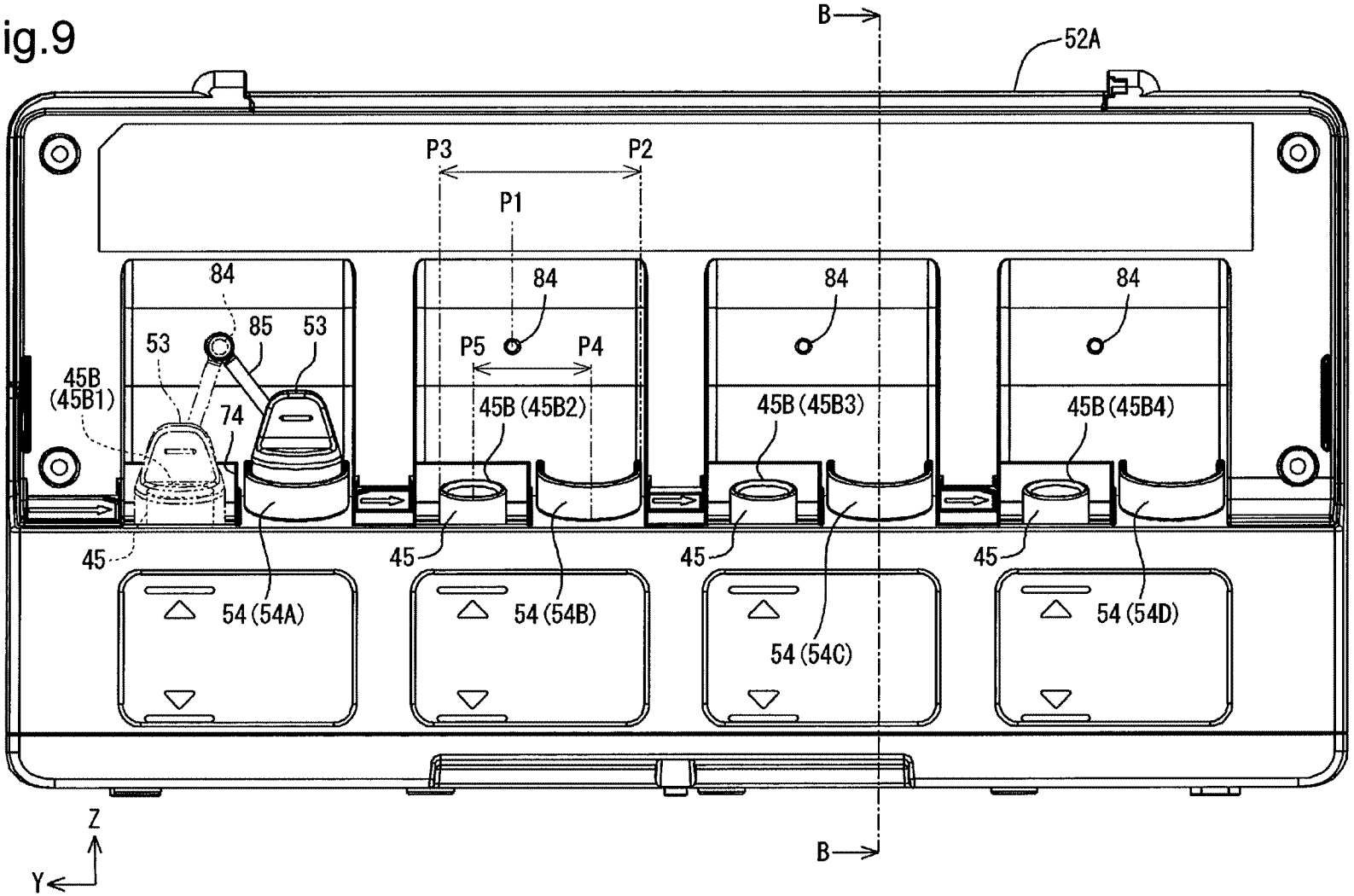
FIG. 9 is a diagram illustrating part of the tank unit viewed in an X-axis direction according to the embodiment.

In the state that the anchor portion 85 is anchored to the connecting portion 84, one cap 53 is allowed to be placed on only a corresponding receiving plate 54 among the four receiving plates 54 as shown in FIG. 9. In the state that the anchor portion 85 is anchored to the connecting portion 84, one cap 53 is allowed to be attached to only a corresponding injection portion 45 among the four injection portions 45. More specifically, the range of motion of each cap 53 in the state that the anchor portion 85 is anchored to the connecting portion 84 is a range between the corresponding ink fill port 45B and the corresponding receiving plate 54. One of factors that implements this configuration is that a position P1 of the connecting portion 84 along the Y-axis direction is located between a position P2 and a position P3 when the main body 52A is viewed from the front side, i.e., when the main body 52A is viewed in the −X-axis direction.

This corresponds to the configuration that the position P1 of the connecting portion 84 along the first direction is between the position P2 of the receiving plate 54 along the first direction and the position P3 of the ink fill port 45B along the first direction when the printer 1 is viewed vertically downward in the use attitude of the printer 1. The position P2 denotes the position of the receiving plate 54 corresponding to the connecting portion 84 along the Y-axis direction. The position P3 denotes the position of the ink fill port 45B corresponding to the connecting portion 84 along the Y-axis direction. More specifically, the position P2 denotes the position at a −Y-axis direction end of the receiving plate 54. The position P3 denotes the position at a Y-axis direction end of the ink fill port 45B. This factor is more likely to adjust the distance from the connecting portion 84 to the receiving plate 54 to the distance from the connecting portion 84 to the ink fill port 45B when the printer 1 is viewed vertically downward in the use attitude of the printer 1. This factor causes the range of motion of each cap 53 to be the range between the corresponding ink fill port 45B and the corresponding receiving plate 54.

Additionally, according to this embodiment, the position P1 of the connecting portion 84 along the Y-axis direction is located between a position P4 and a position P5 when the main body 52A is viewed from the front side, i.e., when the main body 52A is viewed in the −X-axis direction. The position P4 denotes the position of the center of the receiving plate 54 corresponding to the connecting portion 84. The position P5 denotes the position of the center of the ink fill port 45B corresponding to the connecting portion 84. This corresponds to the configuration that the position of the connecting portion 84 along the first direction is between the position of the center of the receiving plate 54 along the first direction and the position of the center of the ink fill port 45B along the first direction when the printer 1 is viewed vertically downward in the use attitude of the printer 1. This factor is furthermore likely to adjust the distance from the connecting portion 84 to the receiving plate 54 to the distance from the connecting portion 84 to the ink fill port 45B when the printer 1 is viewed vertically downward in the use attitude of the printer 1. This factor reduces the length of the anchor portion 85, while maintaining the range of motion of each cap 53 to the range between the corresponding ink fill port 45B and the corresponding receiving plate 54. This reduces the slack of the anchor portion 85.

Figure 10:
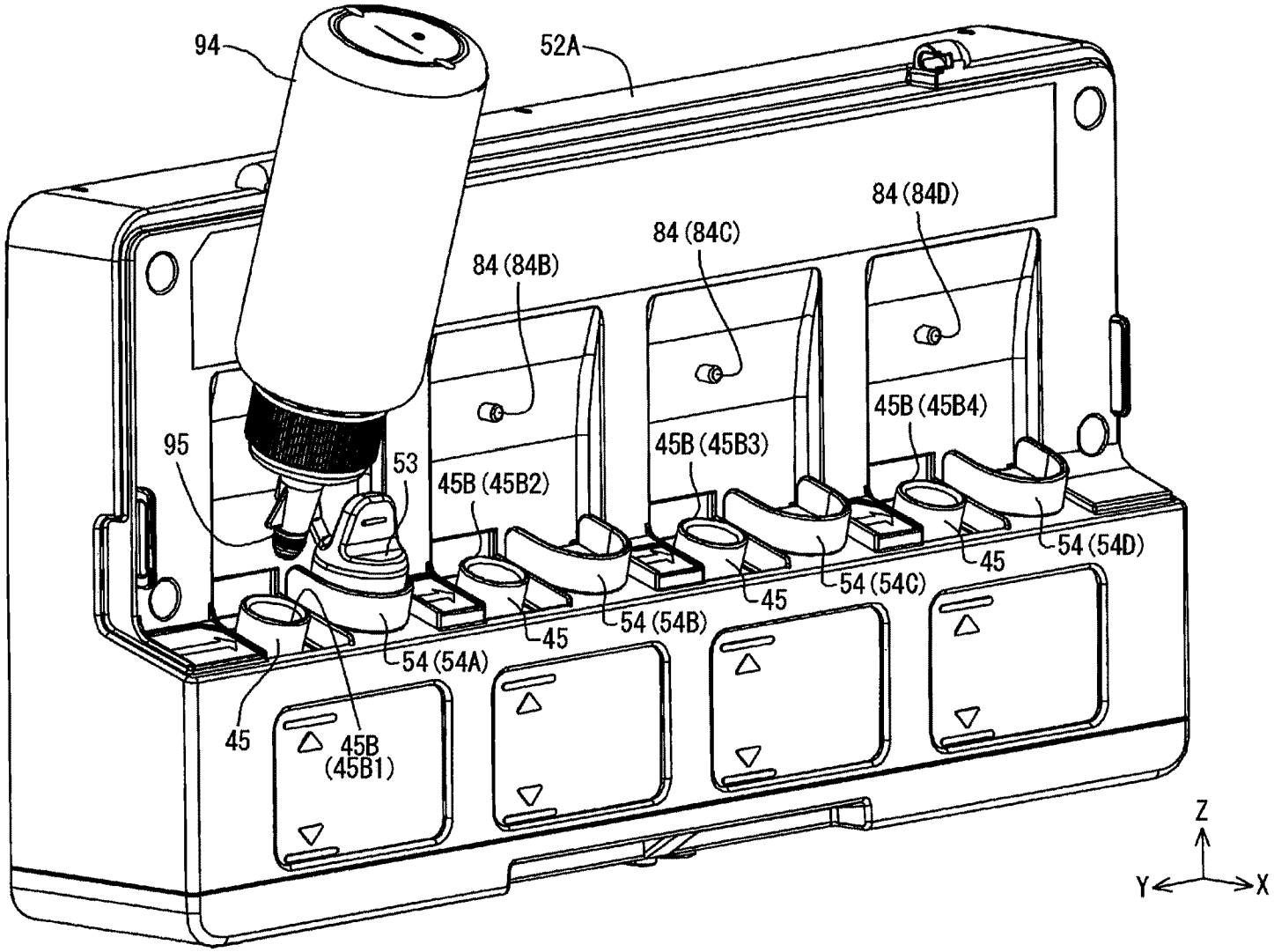
FIG. 10 is a perspective view illustrating part of the tank unit and an ink injection container according to the embodiment.

According to this embodiment, ink contained in an ink injection container 94 may be injected into the tank 10 as shown in FIG. 10. The ink injection container 94 is provided with a nozzle 95 from which ink is discharged. The nozzle 95 is configured in a tubular form. Ink contained in the ink injection container 94 is discharged through the nozzle 95 out of the ink injection container 94. The operator inserts the nozzle 95 of the ink injection container 94 into the ink fill port 45B after removal of the cap 53 from the injection portion 45 and then injects the ink contained in the ink injection container 94 through the injection portion 45 into the tank 10.

Figure 11:
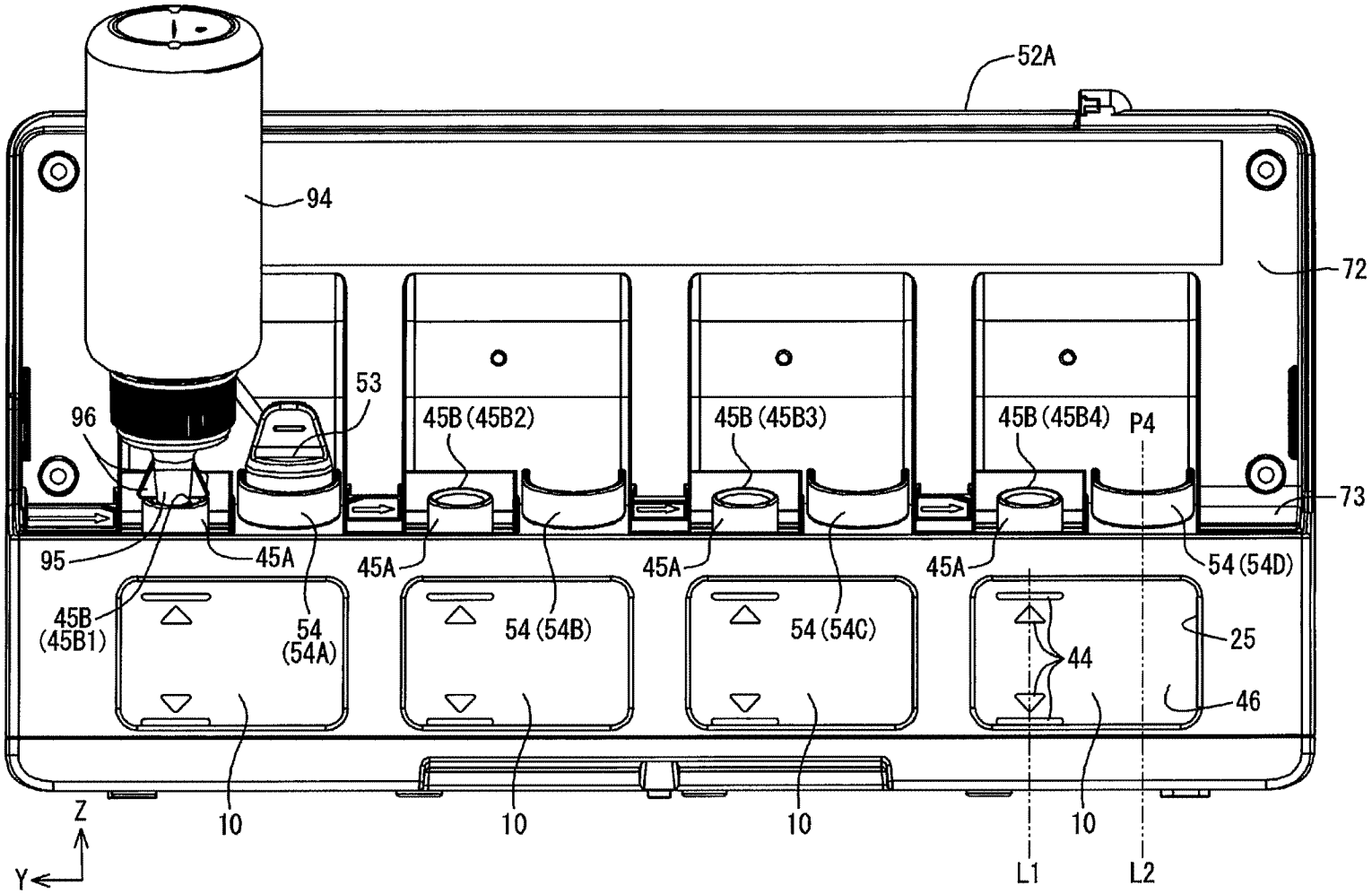
FIG. 11 is a diagram illustrating part of the tank unit and the ink injection container viewed in the X-axis direction according to the embodiment.

The ink injection container 94 is provided with positioning elements 96 as shown in FIG. 11. According to this embodiment, the positioning elements 96 are provided outside of the nozzle 95 in the tubular form. When the nozzle 95 is inserted into the ink fill port 45B, the positioning elements 96 come into contact with a leading end, i.e. outer end, of the ink fill port 45B and determine the degree of insertion of the nozzle 95 into the ink fill port 45B. The insertion of the nozzle 95 into the ink fill port 45B is also called nozzle insertion. According to this embodiment, when the nozzle 95 is inserted into the ink fill port 45B, the positioning elements 96 come into contact with a leading end, i.e. outer end, of the cylinder portion 45A that forms the ink fill port 45B. This configuration enables the position of the ink injection container 94 to be readily controlled relative to the tank 10 when the nozzle 95 of the ink injection container 94 is inserted into the ink fill port 45B.

When the positioning elements 96 come into contact with the leading end of the cylinder portion 45A that forms the ink fill port 45B, there is a gap between the ink injection container 94 and the connecting portion 84. This configuration suppresses the ink injection container 94 from being in contact with the connected portion 91 of the cap 53 that is connected with the connecting portion 84 when the positioning elements 96 of the ink injection container 94 come into contact the ink fill port 45B. As a result, this configuration suppresses the connected portion 91 or the connecting portion 84 from interfering with injection of ink from the ink injection container 94 into the tank 10 and thereby facilitates injection of ink.

The receiving plate 54 on which the cap 53 removed from the injection portion 45 is placed is provided on the wall 73. There is a possibility that ink adhering to the injection portion 45 adheres to the cap 53 attached to the injection portion 45. According to this embodiment, the receiving plate 54 serves to receive the ink adhering to the cap 53. This configuration suppresses the ink adhering to the cap 53 from being transferred to another location.

According to this embodiment, as shown in FIG. 11, when the main body 52A is viewed from the front side, i.e., when the main body 52A is viewed in the −X-axis direction, a vertical line L1 passing through the center in the Y-axis direction of the marker 44 provided on the visible plane 46 of the tank 10 and a vertical line L2 passing through the position P4 of the receiving plate 54 are shifted from each other. This configuration suppresses the ink dripping off from the receiving plate 54 from adhering to the marker 44 provided on the visible plane 46.

Figure 12:
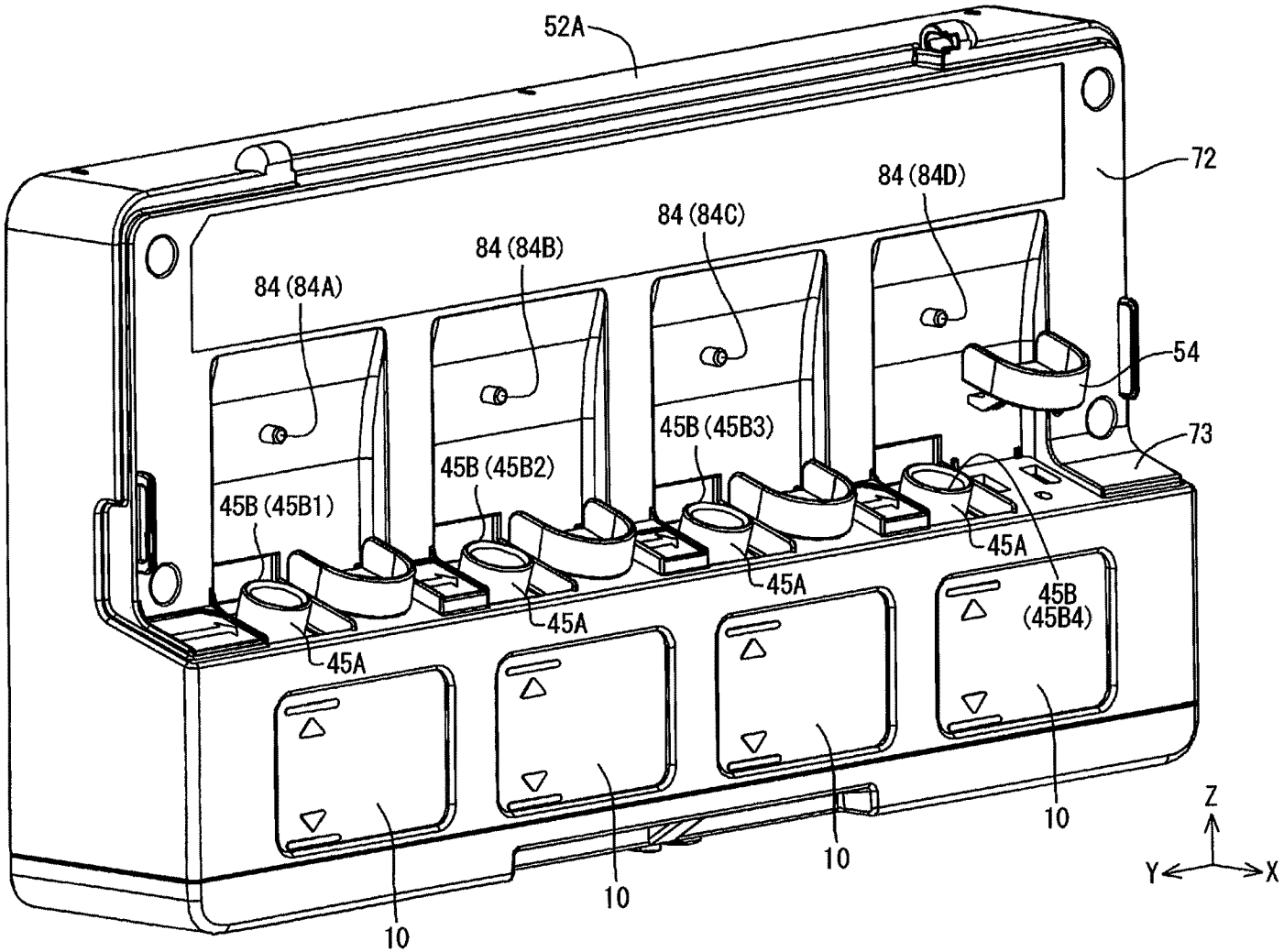
FIG. 12 is an exploded perspective view illustrating part of the tank unit according to the embodiment.

As shown in FIG. 12, the receiving plates 54 are provided separately from the main body 52A and are configured to be removed from the main body 52A. According to this embodiment, the receiving plates 54 are configured to be attachable to and detachable from the main body 52A. This configuration that the receiving plates 54 are attachable to and detachable from the main body 52A enables the receiving plates 54 to be readily cleaned by detachment from the main body 52A.

Figure 13:
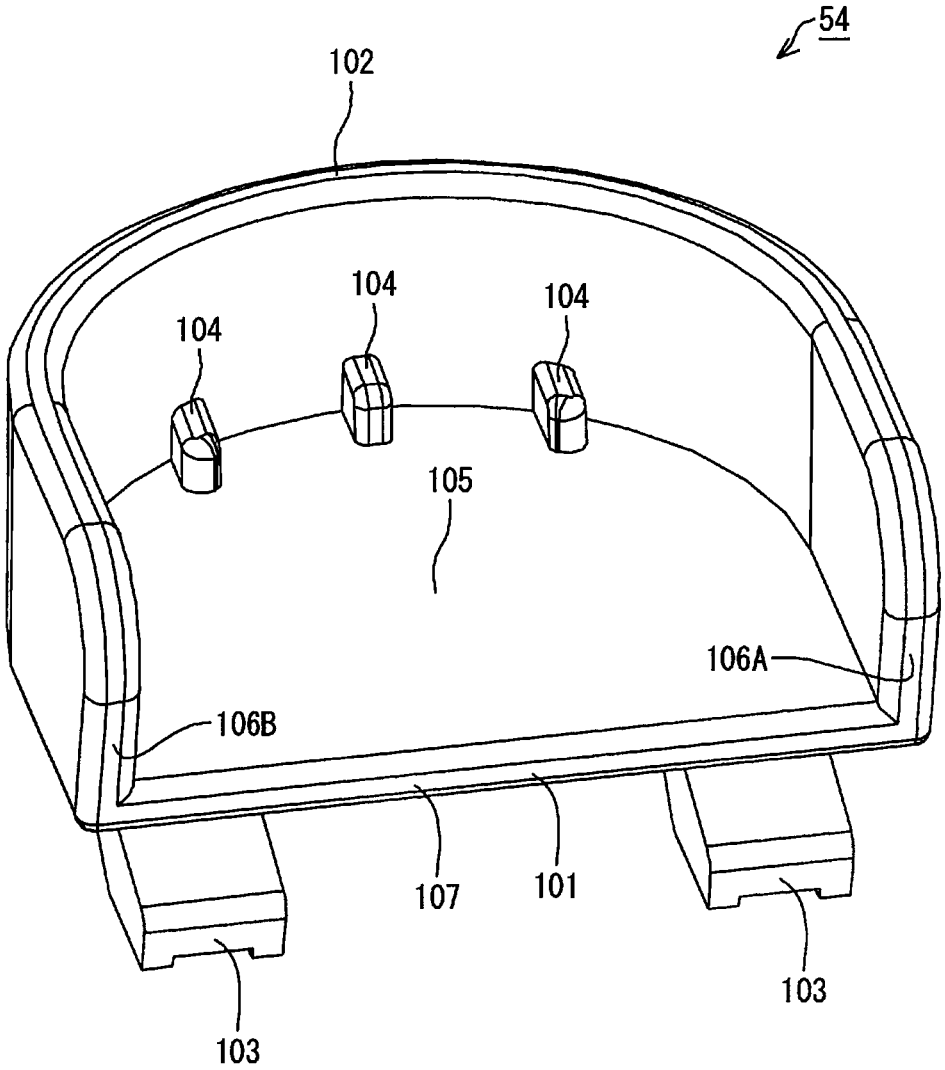
FIG. 13 is a perspective view illustrating a receiving plate according to the embodiment.

As shown in FIG. 13, the receiving plate 54 includes a base portion 101, a partition wall 102, engagement pawls 103 and ribs 104. The base portion 101 has a plate-like appearance and includes a placement surface 105 that faces upward in the use attitude of the receiving plate 54. The placement surface 105 is a surface which the cap 53 is placed on. The partition wall 102, the engagement pawls 103 and the ribs 104 are provided on the base portion 101. The partition wall 102 and the ribs 104 are provided on the placement surface 105 of the base portion 101. The engagement pawls 103 are provided on an opposite side of the base portion 101 that is opposite to the placement surface 105-side. According to this embodiment, a plurality of the ribs 104 and a plurality of the engagement pawls 103 are provided in the receiving plate 54. In the illustrated example of FIG. 13, the receiving plate 54 includes three ribs 104 and two engagement pawls 103. The number of the ribs 104 is, however, not limited to three but may be a number less than three or may be a number greater than three. The number of the engagement pawls 103 is not limited to two but may be one or may be a number greater than two.

The partition wall 102 is protruded upward from the placement surface 105 in the use attitude of the receiving plate 54. The partition wall 102 is arranged to define the placement surface 105. According to this embodiment, the partition wall 102 is arranged to define part of the outer circumference of the placement surface 105. According to another configuration of the receiving plate 54, the partition wall 102 may be arranged to define the entire outer circumference of the placement surface 105. In other words, either one of the configuration that the partition wall 102 is arranged to surround the entire circumference of the placement surface 105 and the configuration that the partition wall 102 is arranged to surround part of the entire circumference of the placement surface 105 may be employed as the configuration of the receiving plate 54. In the configuration that the partition wall 102 is arranged to surround the entire circumference of the placement surface 105, the partition wall 102 is joined in a ring shape.

In the configuration that the partition wall 102 is arranged to surround part of the entire circumference of the placement surface 105, on the other hand, as shown in FIG. 13, the partition wall 102 is not joined in a ring shape but is partly opened. According to this embodiment, one end 106A and the other end 106B of the partition wall 102 are not joined with each other in a ring shape but are separated from each other. In the description below, a part of the base portion 101 between the end 106A and the end 106B, i.e., a non-overlapping part with the partition wall 102, is expressed as an open end 107.

The three ribs 104 are protruded upward from the placement surface 105 in the use attitude of the receiving plate 54. The three ribs 104 are provided in a location where the placement surface 105 intersects with the partition wall 102. The three ribs 104 are extended from the placement surface 105 to the partition wall 102 across the intersection between the placement surface 105 and the partition wall 102. The three ribs 104 are arrayed along the partition wall 102. The three ribs 104 are provided in part of the intersection between the placement surface 105 and the partition wall 102 that is opposed to the open end 107 of the base portion 101.

Figure 14:
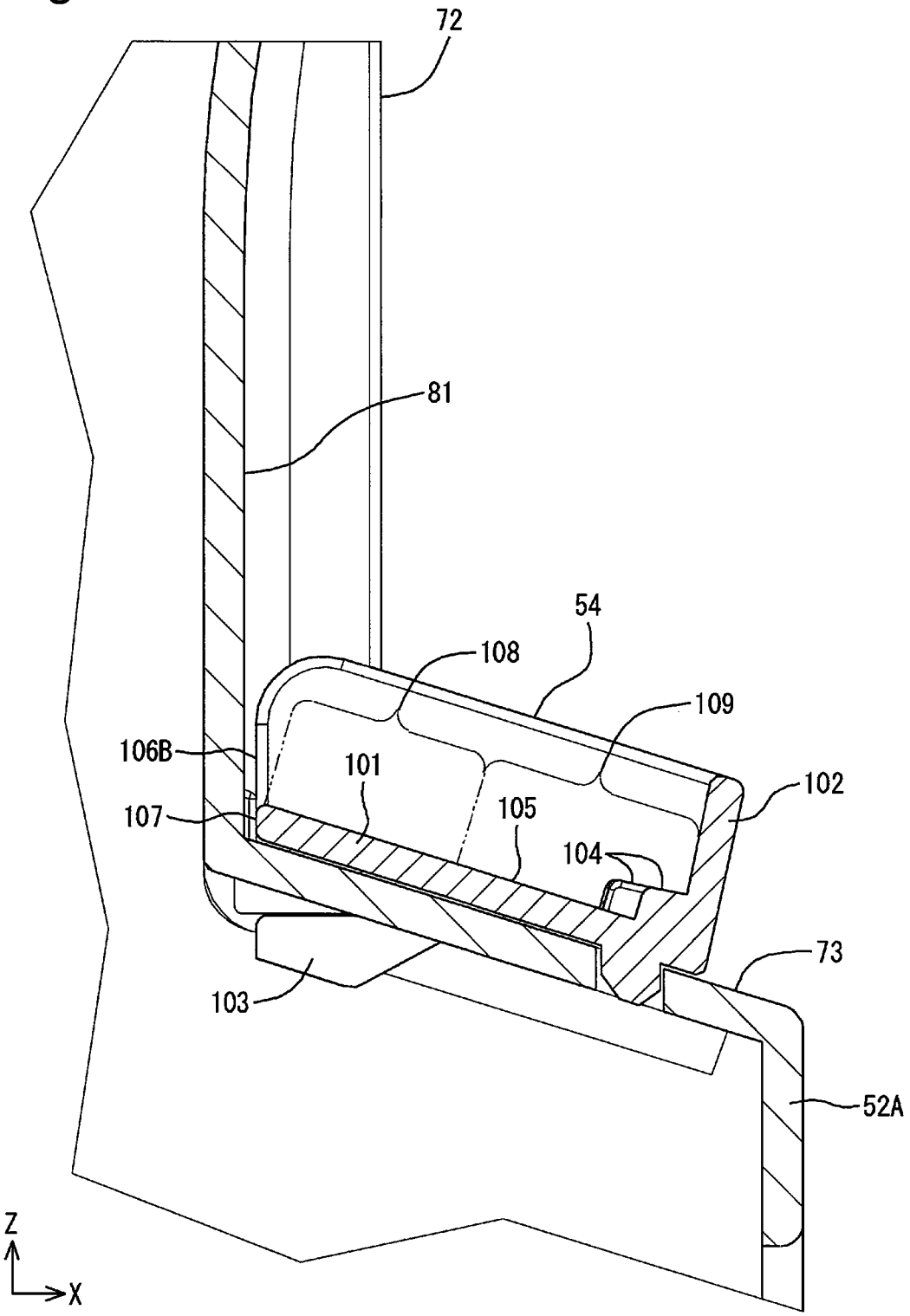
FIG. 14 is a sectional view illustrating the receiving plate and a main body taken on a line B-B in FIG. 9 according to the embodiment.

In the use attitude of the printer 1, the receiving plate 54 is inclined as shown in FIG. 14 that is a sectional view of the receiving plate 54 and the main body 52A taken on a line B-B in FIG. 9. This configuration is attributed to inclination of the wall 73 of the main body 52A. The wall 73 is inclined toward the −Z-axis direction side from the −X-axis direction side to the X-axis direction side. Similarly to the inclination of the wall 73, the receiving plate 54 is inclined toward the −Z-axis direction side from the −X-axis direction side to the X-axis direction side. The placement surface 105 of the receiving plate 54 is accordingly inclined in the use attitude of the printer 1. More specifically, the placement surface 105 is inclined toward the −Z-axis direction side from the −X-axis direction side to the X-axis direction side.

The receiving plate 54 is inclined downward from the open end 107 of the base portion 101 to the ribs 104. Accordingly the placement surface 105 is also inclined downward from the open end 107 of the base portion 101 toward the ribs 104. When the placement surface 105 is divided into two regions, i.e., a higher region 108 and a lower region 109 in inclination, the partition wall 102 is provided in at least the lower region 109. According to this embodiment, the partition wall 102 is thus arranged to define the lowest position of the placement surface 105 in inclination. In the receiving plate 54, the partition wall 102 is arranged to define at least the lowest position of the inclined placement surface 105. The partition wall 102 accordingly serves to trap the ink that flows down along the inclination of the placement surface 105.

According to this embodiment, the partition wall 102 is extended from the lower region 109 to the higher region 108. The partition wall 102 is separated in the part between the end 106A and the end 106B in the higher region 108. According to this embodiment, the three ribs 104 are provided in the lower region 109 out of the two regions, i.e., the higher region 108 and the lower region 109.

Figure 15:
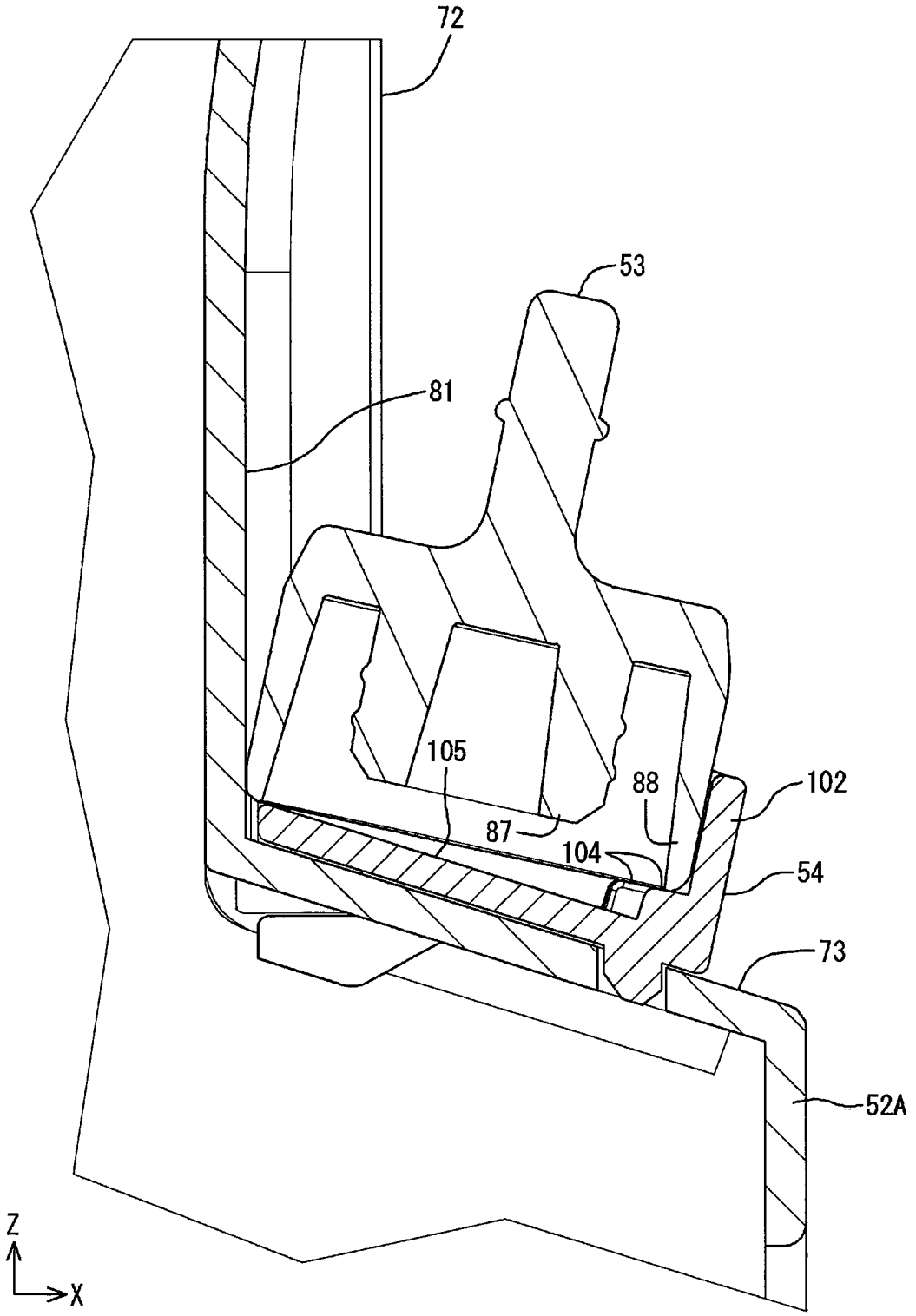
FIG. 15 is a sectional view illustrating the receiving plate, the cap and the main body taken on the line B-B in FIG. 9 according to the embodiment.

When the cap 53 is placed on the receiving plate 54 having the above configuration, the skirt portion 88 of the cap 53 is placed over the ribs 104 and the placement surface 105 as shown in FIG. 15. The cap 53 is accordingly placed on the ribs 104 and the placement surface 105. The ribs 104 serve to separate at least part of the cap 53 from the placement surface 105. This configuration suppresses ink dripping off from the seal portion 87 of the cap 53 to the placement surface 105 from adhering to the cap 53.

When the cap 53 is paced on the receiving plate 54, the seal portion 87 of the cap 53 is located in an area that is away from the ribs 104 across a gap. This configuration suppresses ink adhering to the seal portion 87 from adhering to the ribs 104 of the receiving plate 54. According to this embodiment, a fixation force for fixing the position relative to the receiving plate 54 is not applied to the cap 53 that is placed on the receiving plate 54. A method of press-fitting the cap 53 onto a projection such as a conventional cross element may be a method of applying the fixation force to the cap 53. Such a fixation force is, however, not applied to the cap 53 according to this embodiment. This configuration makes it less likely to apply the momentum of splattering ink to the cap 53 when the cap 53 placed on the receiving plate 54 is lifted up from the receiving plate 54. The cap 53 can thus be gently lifted up from the receiving plate 54. The configuration of this embodiment is less likely to splatter the ink and thereby further enhances the convenience of the cap 53.

According to this embodiment, the receiving plate 54 may be configured to be provided with a marker indicating information with regard to ink. The marker herein means a concept including any of, for example, figures, patterns, tones, colors, letters and symbols. The marker may be configured by using any of these elements alone or by using any of these elements in combination or in connection. The letters herein include numerals. The configuration of the receiving plates 54 provided with the markers is especially effective to facilitate discrimination of the plurality of receiving plates 54 corresponding to the respective ink fill ports 45B in the printer 1 provided with the plurality of receiving plates 54.

According to this embodiment, when the printer 1 is viewed from the Z-axis direction side in the use attitude of the printer 1, respective corresponding sets of the receiving plates 54 and the ink fill ports 45B are arrayed in the Y-axis direction. The markers provided on the respective receiving plates 54 facilitates discrimination of the plurality of ink fill ports 45B from one another. The markers provided on the respective receiving plates 54 serve to distinguish the plurality of receiving plates 54 corresponding to the respective ink fill ports 45B and also serve to distinguish the plurality of ink fill ports 45B from one another. For example, when inks of different colors are contained in the respective tanks 10, indications by the colors corresponding to the respective ink colors may be employed as the markers provided on the respective receiving plates 54. This configuration allows for intuitive discrimination.

The configuration of the receiving plates 54 provided with the markers indicating information with regard to inks suppresses a wrong type of ink from being injected into each ink fill port 45B and suppresses each cap 53 from being placed on a wrong receiving plate 54. This configuration accordingly suppresses, for example, the tank 10 from being contaminated with a wrong type of ink. Placing the cap 53 on a wrong receiving plate 54 is likely to cause multiple different types of inks to adhere to one cap 53 via the receiving plate 54. Attachment of the cap 53 with multiple different types of inks adhering thereto to the injection portion 45 is likely to cause the tank 10 to be contaminated with the multiple different types of inks via the cap 53. The configuration of the receiving plates 54 provided with the markers indicating information with regard to inks reduces such a possibility.

Figure 16:
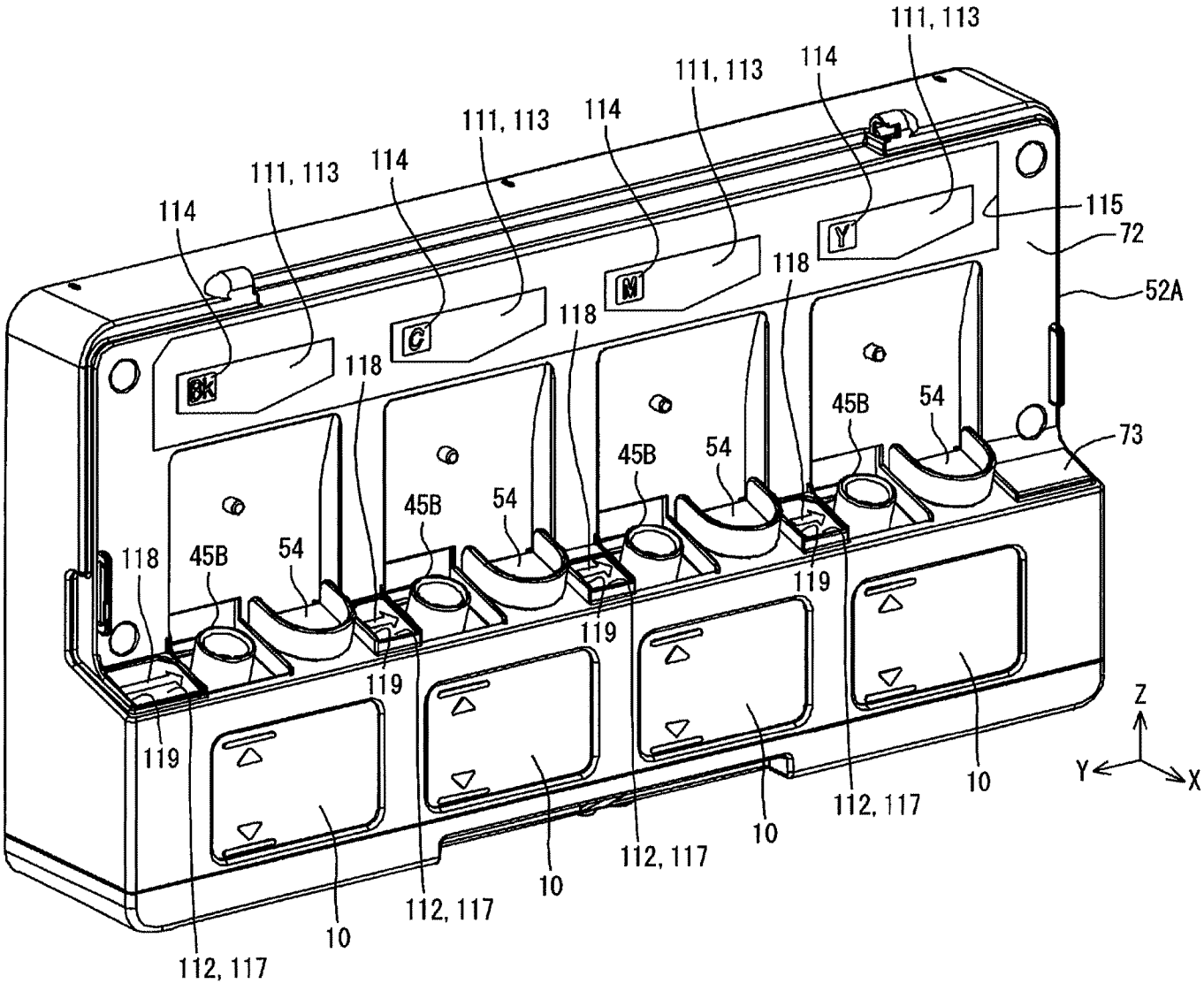
FIG. 16 is a perspective view illustrating part of the tank unit according to the embodiment.

According to this embodiment, as shown in FIG. 16, the main body 52A may be configured to include markers 111 and markers 112 indicating information with regard to inks. The markers 111 and the markers 112 are concepts including any of, for example, figures, patterns, tones, colors, letters and symbols. The marker 111 or the marker 112 may be configured by using any of these elements alone or by using any of these elements in combination or in connection. The letters herein include numerals.

The marker 111 is provided for each ink fill port 45B. Four markers 111 are provided according to this embodiment having the four ink fill ports 45B. According to this embodiment, the marker 111 is configured in the form of a label 113 attached to the wall 72 of the main body 52A. The label 113 includes a mark 114 expressed by, for example, any of figures, patterns, tones, colors, letters and symbols. In the illustrated example of FIG. 16, alphabet letters "Bk" indicating black ink, "C" indicating cyan ink, "M" indicating magenta ink and "Y" indicating yellow ink are provided as the marks 114.

An area 115 where the labels 113 are to be attached to is provided in the wall 72 of the main body 52A. The area 115 is recessed in the −X-axis direction from the wall surface of the wall 72. The area 115 is accordingly formed as a concave in the wall 72. The labels 113 are attached in the recessed area 115. This configuration suppresses the labels 113 from being protruded beyond the wall surface of the wall 72 from the recessed area 115 and thereby suppresses the label 113 from being in contact with the ink injection container 94 shown in FIG. 11 and the like. This configuration thus suppresses the label 113 from being peeled off from the main body 52A. Employing indications by the colors corresponding to the ink colors is likely to allow for intuitive discrimination of the respective ink fill ports 45B and the respective receiving plates 54 by the ink colors.

The marker 112 is also provided for each ink fill port 45B. Four markers 112 are provided according to this embodiment having the four ink fill ports 45B. According to this embodiment, the marker 112 is configured in the form of a label 117 attached to the wall 73 of the main body 52A. The label 117 includes a mark 118 expressed by, for example, any of figures, patterns, tones, colors, letters and symbols. In the illustrated example of FIG. 16, arrow symbols indicating the respective ink fill ports 45B corresponding to the markers 112 are provided as the marks 118. The markers 112 also adopt indications by different colors for the respective ink fill ports 45B corresponding to the respective ink colors. With respect to the four markers 112, the labels 117 are formed in different shapes and in different sizes for the respective ink fill ports 45B. The labels 117 accordingly have different shapes and different sizes from one another.

Attachment areas 119 where the labels 117 are to be attached to are provided for the respective ink fill ports 45B in the wall 73 of the main body 52A. According to this embodiment having the four ink fill ports 45B, four attachment areas 119 are provided. The four attachment areas 119 are formed in different shapes and in different sizes for the respective ink fill ports 45B. The four attachment areas 119 accordingly have different shapes and different sizes from one another. With respect to the four attachment areas 119, the shapes and the sizes of the respective attachment areas 119 are to be associated with the shapes and the sizes of the corresponding labels 117. More specifically, with respect to the four attachment areas 119, the shapes and the sizes of the attachment areas 119 differ from one another according to the shapes and the sizes of the corresponding labels 117.

According to this embodiment, each label 117 provided for a corresponding ink fill port 45B is thus likely to be attached to only a corresponding attachment area 119. In other words, there is a difficulty in attaching a label 117 to any of different attachment areas 119 other than the attachment area 119 corresponding to this label 117. As a result, this configuration suppresses each label 117 from being attached in a wrong attachment area 119. More specifically, this configuration suppresses each label 117 provided for a corresponding ink fill port 45B from being mistakenly attached to a wrong ink fill port 45B. This configuration thereby ensures accurate association of the labels 117 with the ink fill ports 45B.

Each of the attachment areas 119 is recessed downward from the wall surface of the wall 73 of the main body 52A. The attachment area 119 is accordingly formed as a concave in the wall 73. The labels 117 are attached in the respective recessed attachment areas 119. This configuration suppresses the labels 117 from being protruded beyond the wall surface of the wall 73 from the recessed attachment areas 119 and thereby suppresses the label 117 from being in contact with the ink injection container 94 shown in FIG. 11 and the like. This configuration thus suppresses the label 117 from being peeled off from the main body 52A.

Figure 17:
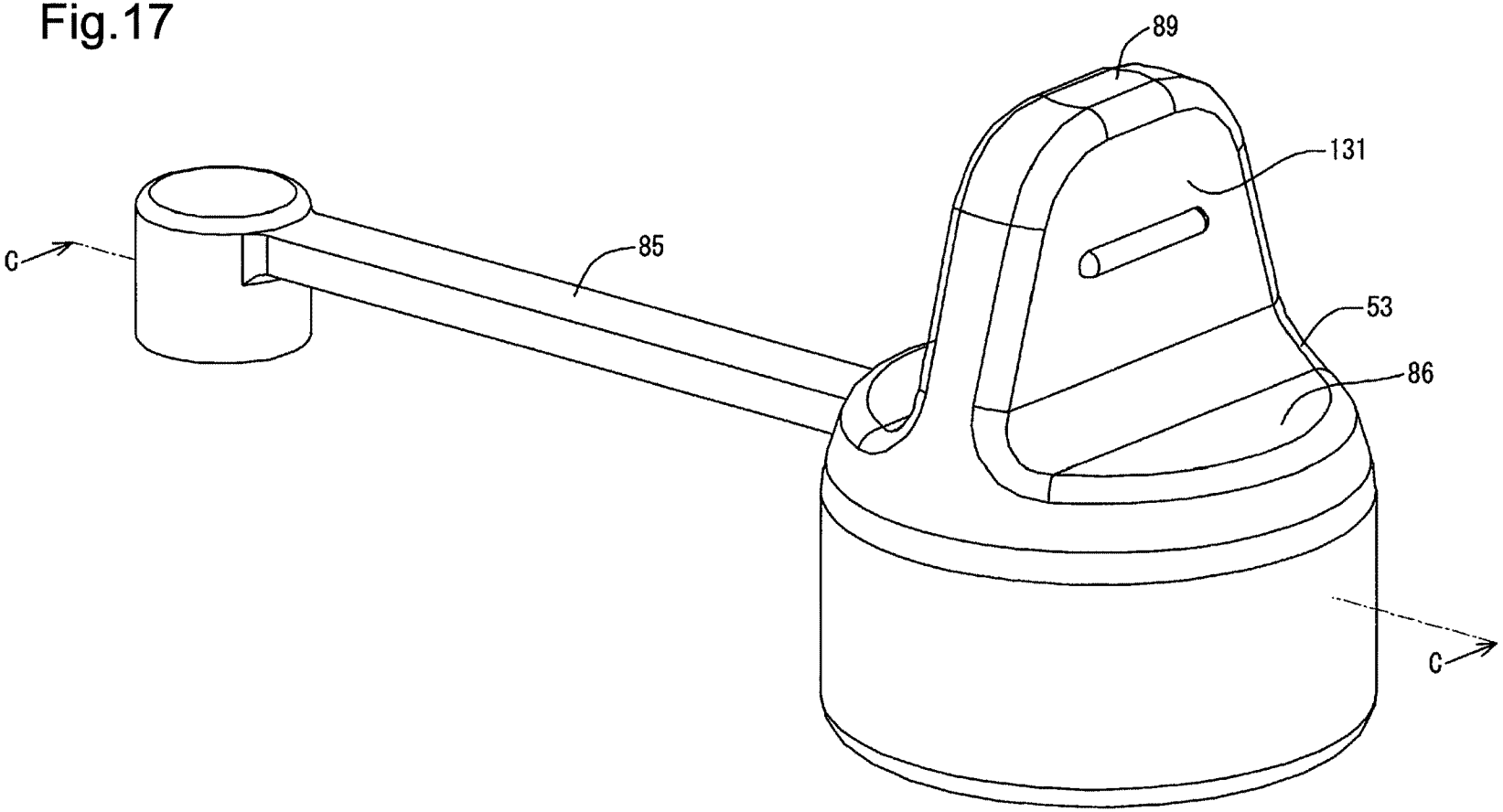
FIG. 17 is a perspective view illustrating the cap according to the embodiment.
Figure 18:
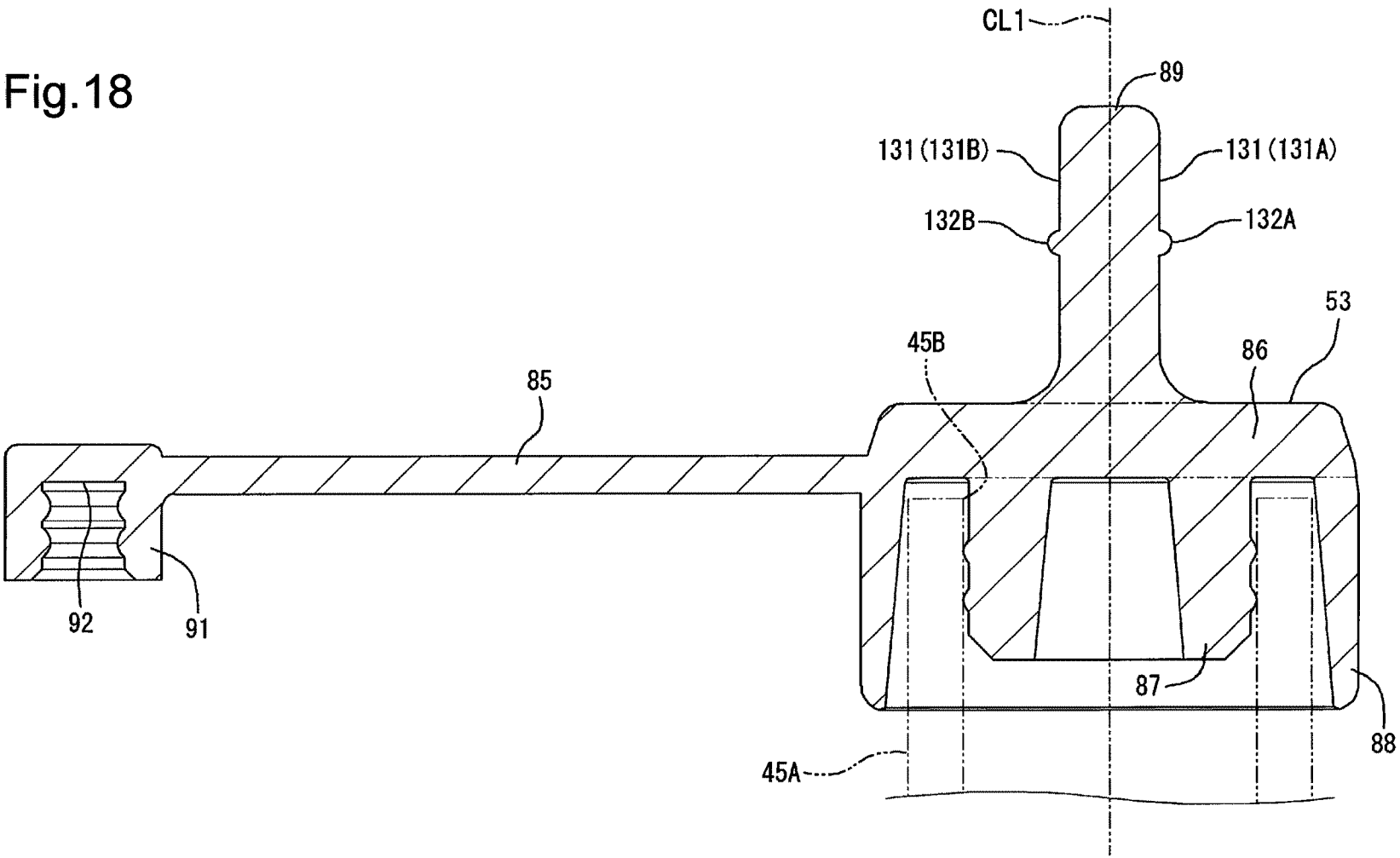
FIG. 18 is a sectional view taken on a line C-C in FIG. 17.

According to this embodiment, the grip portion 89 of the cap 53 is provided in a plate-like form that is protruded from the covering portion 86 as shown in FIG. 17. The operator grasps the plate-like grip portion 89 with the thumb and fingers, so as to hold the grip portion 89. The grip portion 89 is readily held by grasping grip faces 131 that are largest faces arranged opposite to each other among faces constituting the outer shell of the grip portion 89, with the thumb and fingers. When there is a need to distinguish the opposite grip faces 131 from each other, the two grip faces 131 are respectively expressed as grip face 131A and grip face 131B as shown in FIG. 18 that is a sectional view taken on a line C-C in FIG. 17.

The grip face 131A is provided with a projection 132A. The grip face 131B is provided with a projection 132B. The projection 132A is protruded from the grip face 131A in an opposite direction to the grip face 131B-side. The projection 132B is protruded from the grip face 131B in an opposite direction to the grip face 131A-side. In other words, the projection 132A and the projection 132B are respectively protruded outward of the grip portion 89. The projection 132A and the projection 132B serve to suppress slippage of the thumb and fibers grasping the grip portion 89 and thereby enables the operator to securely hold the grip portion 89.

Figure 19:
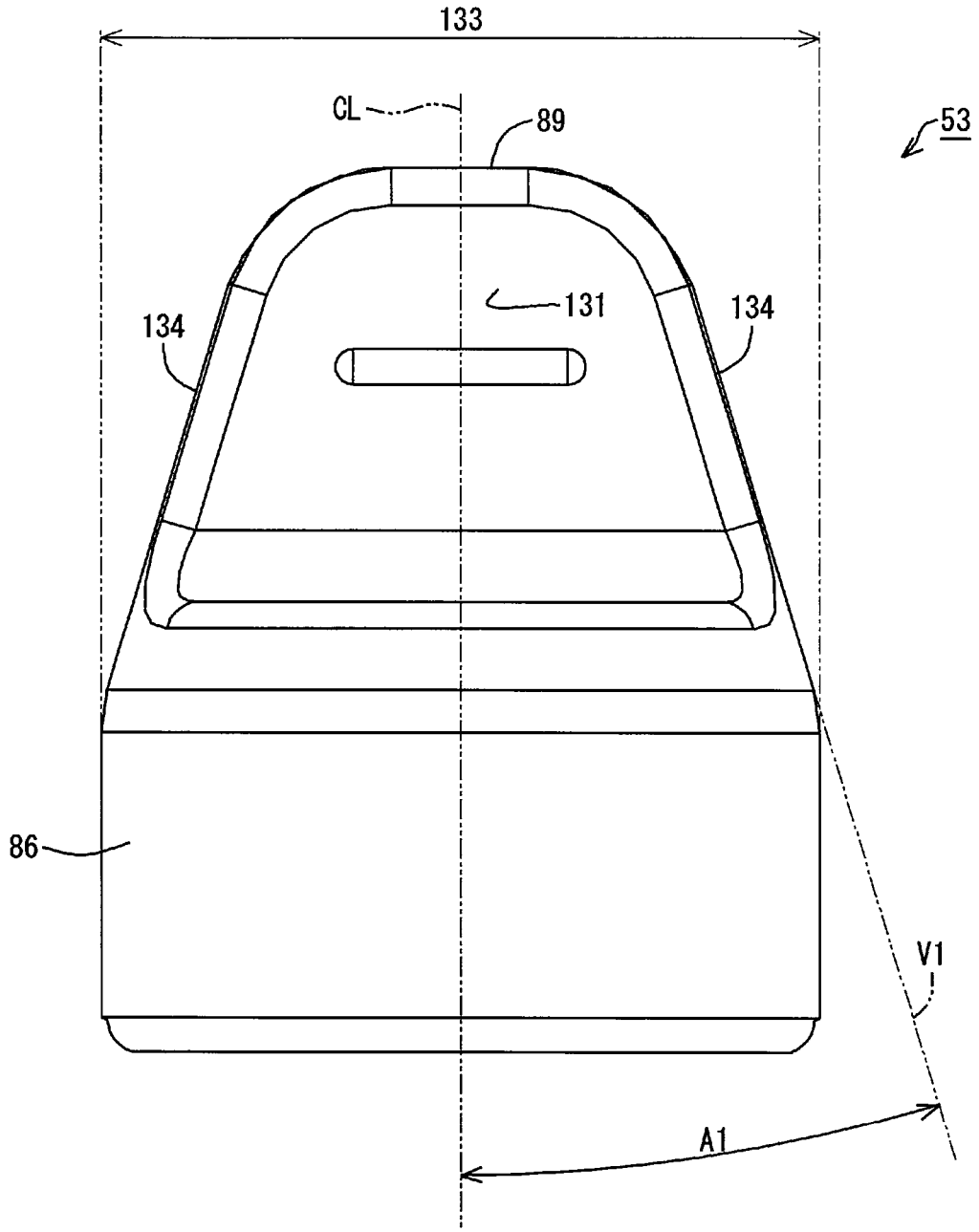
FIG. 19 is a diagram illustrating the cap with a grip face of the cap viewed from a front side according to the embodiment.

With respect to the cap 53, when the grip face 131 is viewed from the front side, the grip portion 89 is located within an area 133 of the outer shell of the covering portion 86 as shown in FIG. 19. The area 133 is equivalent to the trajectory drawn by the covering portion 86 when the covering portion 86 is translated toward the grip portion 89. The area 133 is also are area overlapping with the covering portion 86 in the plan view of the cap 53 in a direction from the grip portion 89 toward the covering portion 86. The grip portion 89 is accordingly contained in the area overlapping with the covering portion 86 in the plane view of the cap 53 in a direction from the grip portion 89 toward the covering portion 86. Additionally, according to this embodiment, sloped parts 134 are formed in the grip portion 89. The sloped part 134 is sloped inward of the area 133 from the covering portion 86-side to an opposite end of the grip portion 89 that is on the opposite side to the covering portion 86-side. Providing the sloped parts 134 suppresses the grip portion 89 from being extended out of the area 133. This configuration allows for downsizing of the cap 53. The grip portion 89 is provided with two sloped parts 134 according to this embodiment, but the number of the sloped part 134 may be one. With respect to the cap 53, the presence of the sloped parts 134 in the grip portion 89 increases the width on the covering portion 86-side. This configuration helps the operator grasp the covering portion 86-side of the grip faces 131 with the thumb and fingers and thereby enables the operator to readily attach and detach the cap 53.

In other words, the cap 53 has two sloped parts 134 that are opposed to each other in a direction intersecting with a center axis CL of the cap 53, as shown in FIG. 19. The grip faces 131 are provided to connect the two sloped parts 134 with each other. As shown in FIG. 18, the two grip faces 131 are arranged opposite to each other to be approximately parallel to the direction of a center axis CL1 of the ink fill port 45B when the cap 53 is attached to the ink fill port 45B. The cap 53 accordingly includes the two sloped parts 134 that are opposed to each other in the direction intersecting with the center axis CL of the cap 53 shown in FIG. 19, and the two grip faces 131 that are provided to connect the two sloped parts 134 with each other and are arranged opposite to each other to be approximately parallel to the direction of the center axis CL1 of the ink fill port 45B shown in FIG. 18 when the tank 53 is attached to the ink fill port 45B. The grip face 131 corresponds to the flat portion. This configuration allows for downsizing of the cap 53, compared with a configuration that the sloped parts 134 are not sloped but are extended in a direction parallel to the center axis CL of the cap 53.

Figure 20:
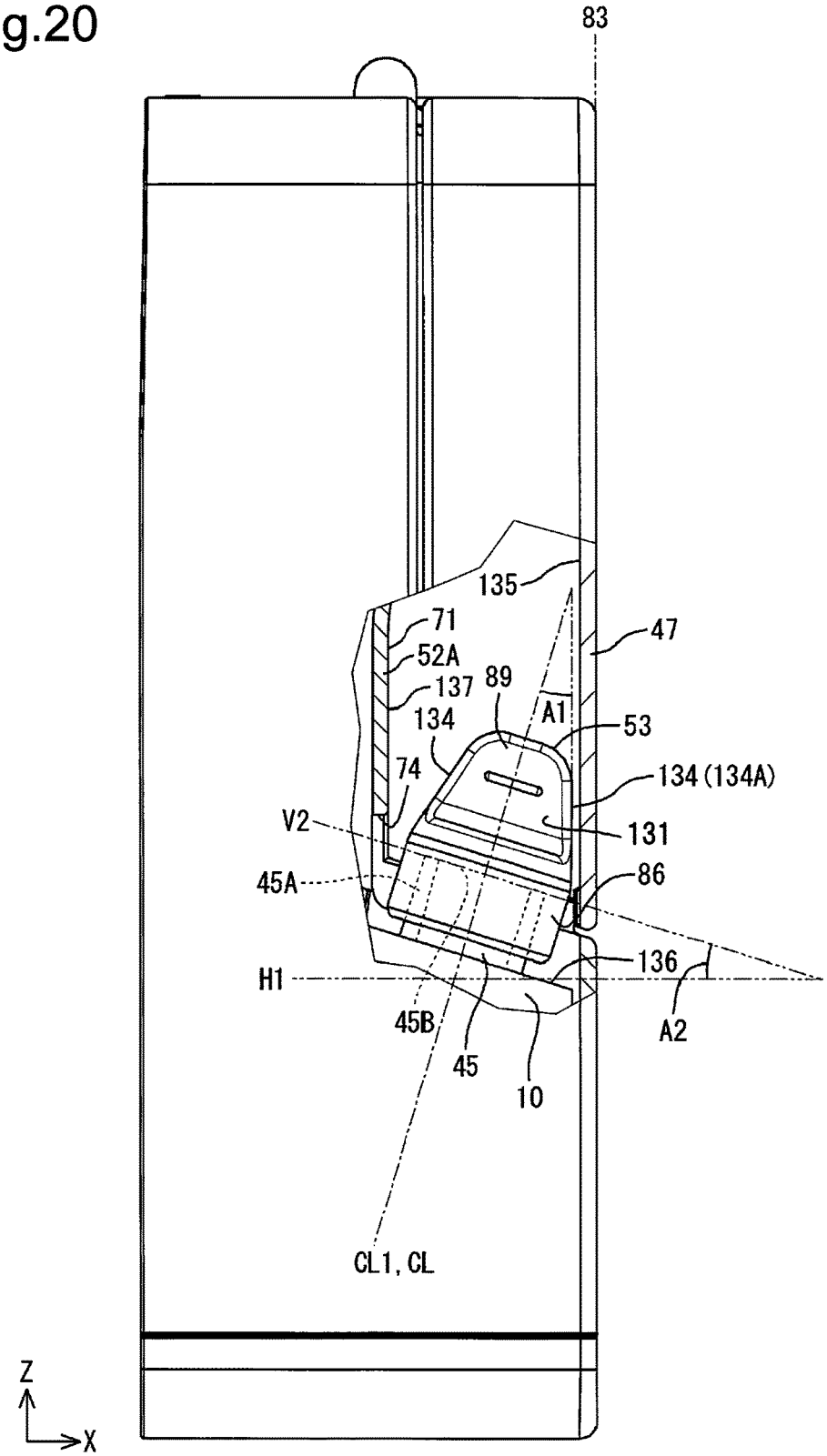
FIG. 20 is a front view illustrating the tank unit according to the embodiment.

According to this embodiment, the cap 53 is located between the main body 52A and the cover 47 along the X axis when the cover 47 is closed to the main body 52A in the state that the cap 53 is attached to the injection portion 45 of the tank 10, as shown in FIG. 20. More specifically, as shown in FIG. 20, when the printer 1 is viewed vertically downward in the use attitude of the printer 1 in the view of FIG. 5, the cap 53 is located at a position on the second direction side of one side 83, i.e., at a position on the −X-axis direction side of one side 83. The second direction herein denotes a direction from one side 83 toward the ink fill ports 45B that intersects with the first direction along one side 83. For the purpose of better understanding of the configuration, part of the main body 52A and part of the cover 47 are broken away in the illustration of FIG. 20.

The main body 52A is located at a position on the −X-axis direction side of the cap 53, and the cover 47 is located at a position on the X-axis direction side of the cap 53. This configuration of the embodiment suppresses the covering portion 86 and the grip portion 89 of the cap 53 from coming into contact with the cover 47 and the main body 52A when the cover 47 is closed to the main body 52A in the state that the cap 53 is attached to the injection portion 45 of the tank 10. In other words, according to the configuration of this embodiment, the cap 53 is placed in a closed space between the covered portion 71 of the main body 52A and an inner face 135 of the cover 47 when the cover 47 is closed to the main body 52A in the state that the cap 53 is attached to the injection portion 45 of the tank 10. This configuration enables the cover 47 to be securely closed to the main body 52A in the state that the cap 53 is attached to the injection portion 45 of the tank 10.

This is implemented by the sloped parts 134 provided on the grip portion 89. The sloped part 134 is formed such that a gap is formed between the grip portion 89 and the cover 47 in the state that the grip faces 131 are arranged along an XZ plane when the cap 53 is attached to the injection portion 45 of the tank 10. More specifically, when a sloped part 134 located closer to the cover 47 in the X-axis direction out of the two sloped parts 134 is expressed as sloped part 134A, there is a gap between the sloped part 134A and the cover 47.

Additionally, according to this embodiment, the sloped part 134A is extended along the Z axis in the state that the grip faces 131 are arranged along an XZ plane when the cap 53 is attached to the injection portion 45 of the tank 10. In this state, the inner face 135 of the cover 47 is also extended along the Z axis. In other words, the inner face 135 of the cover 47 is extended along the vertical direction. In the illustrated state of FIG. 20, the sloped part 134A is approximately parallel to the inner face 135. More specifically, the sloped part 134A is approximately parallel to the inner face 135 when the cover 47 is closed in the state that the cap 53 is attached to the injection portion 45 such that the sloped part 134A of the cap 53 is opposed to the inner face 135. This configuration suppresses the cap 53 from coming into contact with the cover 47 when the cover 47 is closed to the main body 52A, while allowing for size expansion of the grip portion 89. This configuration of the embodiment accordingly enables the cover 47 to be securely closed to the main body 52A in the state that the cap 53 is attached to the injection portion 45 of the tank 10 and enables the operator to securely hold the grip portion 89.

In other words of the above configuration, the cap 53 is located between a wall 137 that is extended along the Z axis in the covered portion 71 of the main body 52A and the inner surface 135 that is extended along the Z axis. The cap 53 is inclined to the Z axis. More specifically, the cap 53 is inclined toward the X-axis direction side, i.e., toward the cover 47 from the −Z-axis direction side to the Z-axis direction side. Accordingly the area 133 of the outer shell of the covering portion 86 shown in FIG. 19 and the inner face 135 of the cover 47 overlap with each other. If the grip portion 89 is formed across the area 133, the grip portion 89 comes into contact with the cover 47. If the grip portion 89 is formed across the area 133, there is accordingly a possibility that the cover 47 fails to be closed to the main body 52A in the state that the cap 53 is attached to the injection portion 45 of the tank 10.

The configuration of this embodiment, however, includes the sloped parts 134 formed on the grip portion 89 and accordingly reduces this possibility. There is a gap between the cap 53 and the inner face 135 when the cover 47 is closed in the state that the cap 53 is attached to the injection portion 45 such that the sloped part 134A of the cap 53 is opposed to the inner face 135. Accordingly the sloped part 134 that is sloped in the direction intersecting with the center axis CL1 of the ink fill port 45B enables the cover 47 to be securely closed to the main body 52A in the state that the cap 53 is attached to the injection portion 45 of the tank 10. The angle formed by intersection of the center axis CL1 with the sloped part 134 is not equal to 90 degrees. According to this embodiment, the smaller angle formed by intersection of the center axis CL1 with the sloped part 134 is equal to the smaller angle formed by intersection of the Z axis with the center axis CL1. In other words, the slope of the sloped part 134 relative to the center axis CL1 is equal to the slope of the center axis CL1 relative to the Z axis. This means that the sloped part 134 is formed to have a slope according to the slope of the ink fill port 45B. The sloped part 134 is accordingly sloped according to the slope of the ink fill port 45B. This configuration enables the sloped part 134 to be readily arranged along the Z axis, i.e., along the vertical direction, in the state that the cap 53 is attached to the injection portion 45 of the tank 10.

When the grip face 131 of the cap 53 is viewed from the front side, as shown in FIG. 19, an angle A1 denotes an angle that is between the center axis CL of the cap 53 and a tangent V1 of the sloped part 134 and that is smaller than 90 degrees. In the use attitude of the printer 1, as shown in FIG. 20, an angle A2 that is between a tangent V2 at an end of the ink fill port 45B and a horizontal line H1 and is smaller than 90 degrees. According to this embodiment, a relationship of the angle A1 the angle A2 is satisfied. This configuration suppresses the cap 53 from coming into contact with the cover 47 when the cover 47 is closed in the state that the cap 53 is attached to the injection portion 45 such that the sloped part 134A of the cap 53 is opposed to the inner face 135, while allowing for size expansion of the grip portion 89.

According to this embodiment, in the use attitude of the printer 1, the tank 10 has an inclined face 136. The injection portion 45 is provided in the inclined face 136. The inclined face 136 is inclined toward the −Z-axis direction side from the −X-axis direction side to the X-axis direction side, like the placement surface 105 of the receiving plate 54 shown in FIG. 14 described above. The placement surface 105 and the inclined face 136 are accordingly inclined in a direction intersecting with the horizontal direction in the use attitude of the printer 1. According to this embodiment, the inclination of the inclined face 136 of the tank 10 is equivalent to the inclination of the placement surface 105 of the receiving plate 54. The inclined face 136 of the tank 10 and the placement surface 105 of the receiving plate 54 are accordingly parallel to each other. The term "parallel" herein is not limited to the strictly parallel state but includes mutually inclined states by some error, tolerance or the like, except the perpendicular state.

The injection portion 45 is inclined according to the inclination of the inclined face 136. The cylinder portion 45A is thus inclined according to the inclination of the inclined face 136. The cylinder portion 45A is inclined toward the inner face 135 of the cover 47. The ink fill port 45B is also inclined according to the inclination of the inclined face 136. The inclination of an end face of the injection portion 45 to which the cap 53 is attached, i.e., the inclination of an end face of the cylinder portion 45A, is thus equivalent to the inclination of the placement surface 105 of the receiving plate 54. This state may be expressed such that the ink fill port 45B is opened relative to the inner face 135 of the cover 47. The cap 53 attached to the injection portion 45 is thus inclined according to the inclination of the inclined face 136.

Accordingly the inclination of the cap 53 attached to the injection portion 45 is equivalent to the inclination of the placement surface 105 of the receiving plate 54. This configuration enables the cap 53 to be moved to the receiving plate 54 while maintaining the inclination of the cap 53, when the cap 53 is removed from the injection portion 45 and is transferred to the receiving plate 54. This configuration enables the cap 53 to be placed on the receiving plate 54 without changing the attitude of the cap 53 removed from the injection portion 45. As a result, this configuration facilitates the operation of removing the cap 53 from the injection portion 45 and transferring the cap 53 to the receiving plate 54.

Additionally, the configuration of this embodiment suppresses the covering portion 86 and the grip portion 89 of the cap 53 from coming into contact with the cover 47 and the main body 52A when the cover 47 is closed to the main body 52A in the state that the cap 53 is placed on the placement surface 105 of the receiving plate 54. In other words, according to this embodiment, the cap 53 is placed in the closed space between the covered portion 71 of the main body 52A and the inner face 135 of the cover 47 when the cover 47 is closed to the main body 52A in the state that the cap 53 is placed on the placement surface 105 of the receiving plate 54.

According to this embodiment, the sloped part 134 is formed such that a gap is formed between the grip portion 89 and the cover 47 in the state that the grip faces 131 are arranged along the XZ plane when the cap 53 is placed on the placement surface 105 of the receiving plate 54. More specifically, there is a gap between the cover 47 and the sloped part 134A that is located closer to the cover 47 in the X-axis direction out of the two sloped parts 134. This configuration enables the cover 47 to be securely closed to the main body 52A in the state that the cap 53 is placed on the placement surface 105 of the receiving plate 54.

Figure 21:
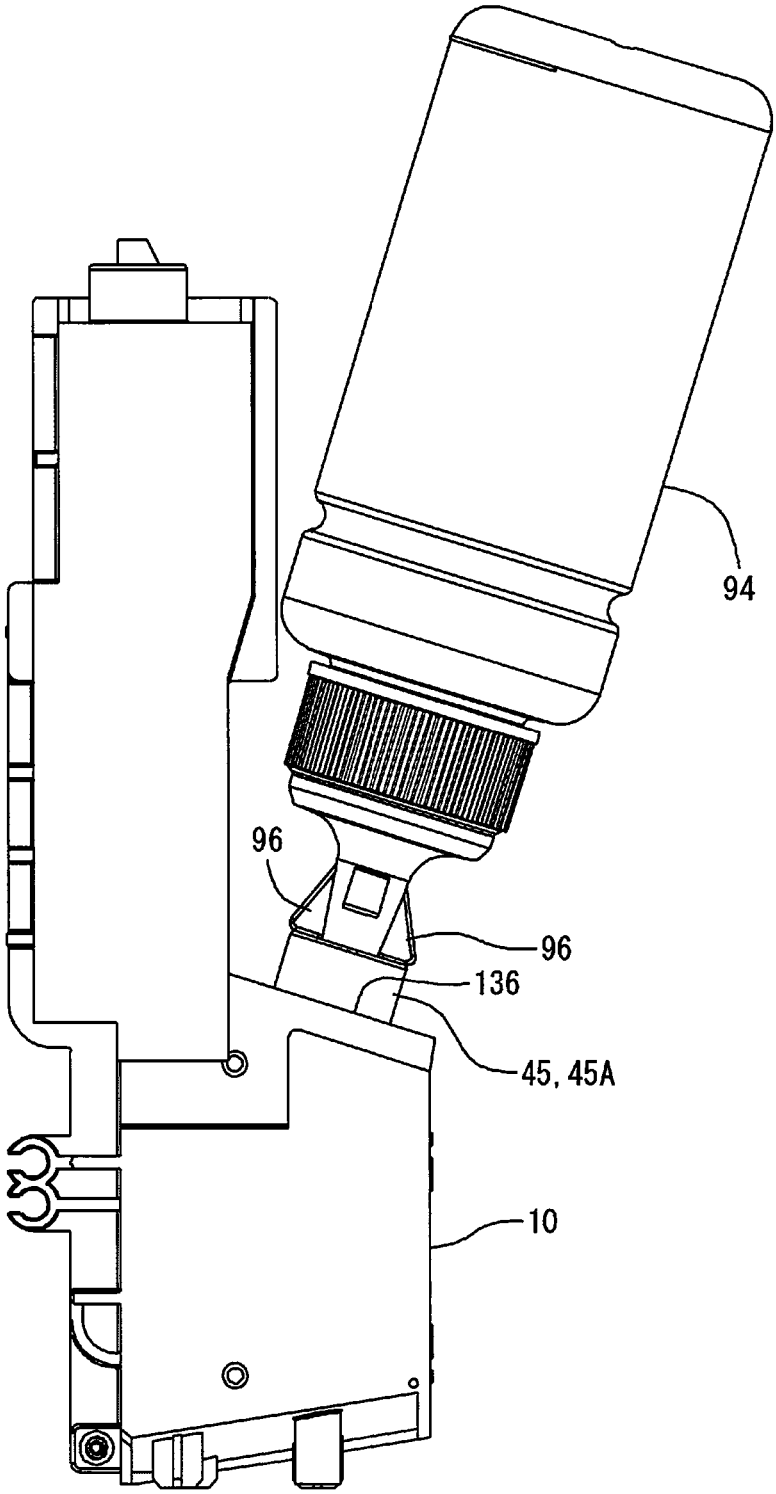
FIG. 21 is a front view illustrating the tank and the ink injection container according to the embodiment.

As shown in FIG. 21, according to this embodiment, the positioning elements 96 of the ink injection container 94 come into contact with a leading end, i.e. outer end, of the cylinder portion 45A in the process of injecting ink from the ink injection container 94 into the injection portion 45. This configuration allows the position of the ink injection container 94 to be readily controlled relative to the injection portion 45. According to this embodiment, the ink fill port 45B is inclined according to the inclination of the inclined face 136. The ink injection container 94 is thus inclined according to the inclination of the inclined face 136 when the positioning elements 96 of the ink injection container 94 come into contact with the leading end of the cylinder portion 45A. Such inclination of the ink injection container 94 enables ink to be readily injected into the injection portion 45 even when there is a difficulty in ensuring a sufficient space for the ink injection container 94 in the circumference of the injection portion 45.

Figure 22:
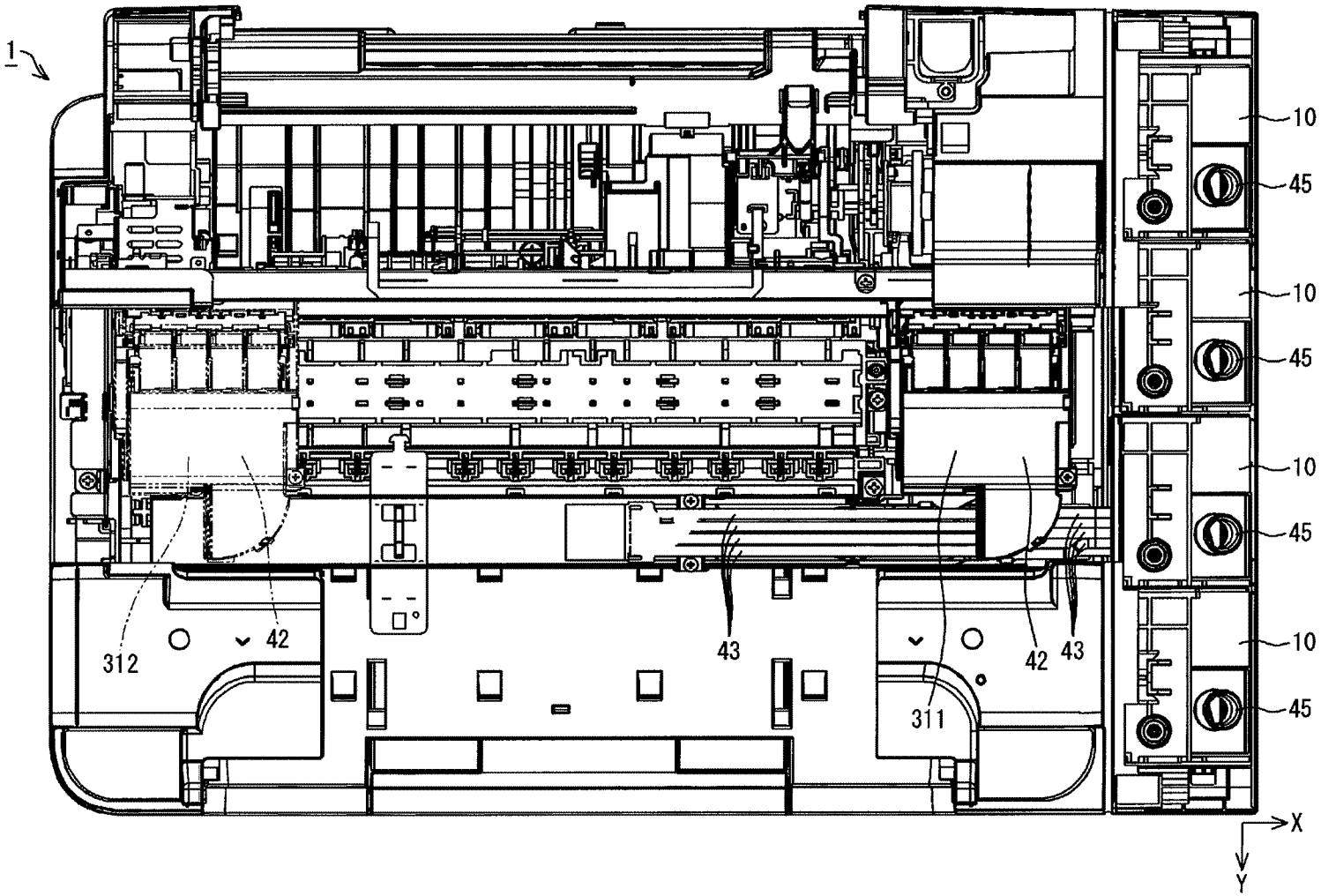
FIG. 22 is a plan view illustrating the main configuration of the printer according to the embodiment.

In the printer 1 of this embodiment, as shown in FIG. 22, the printing portion 42 is configured to be movable back and forth in a range of motion between a standby position 311 and a turning position 312. The ink supply tubes 43 connected with the tanks 10 and the printing portion 42 are configured to flexibly move back and forth according to the reciprocating motions of the printing portion 42. For the purpose of better understanding of the configuration, the scanner unit 5 shown in FIG. 3 and the housing 7 are omitted from the illustration of FIG. 22.

Figure 23:
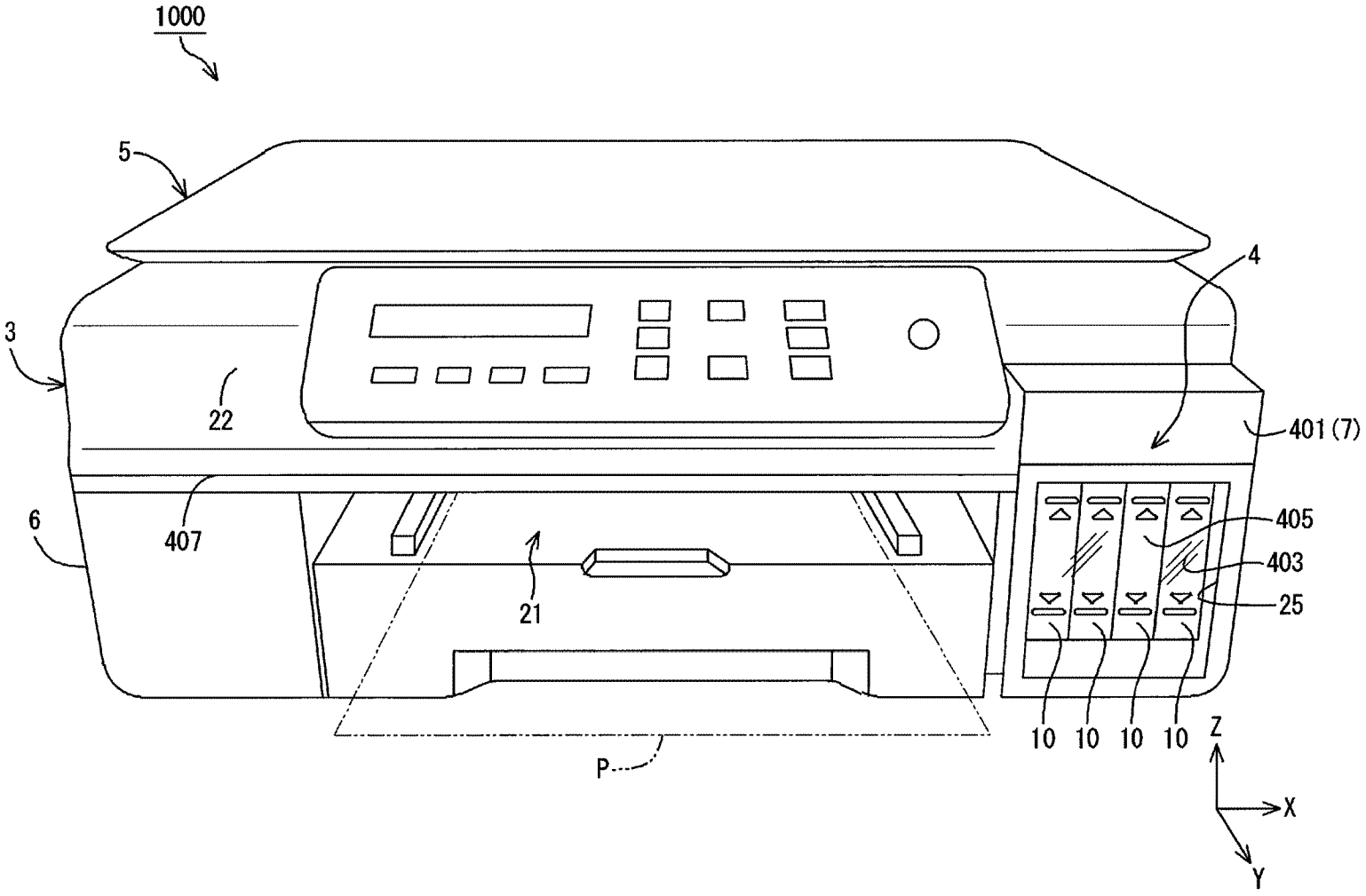
FIG. 23 is an appearance diagram illustrating a printer according to another embodiment.

In the printer 1, the four tanks 10 are arrayed along the Y axis. The direction of array of a plurality of tanks 10 is, however, not limited to the direction along the Y axis. For example, as shown in FIG. 23, another embodiment is a printer 1000 that is configured to include a plurality of tanks 10 arrayed along the X axis. The following describes the configuration of the printer 1000. The like components of the printer 1000 to those of the printer 1 are expressed by the like reference signs to those of the printer 1 and are not described in detail.

The printer 1000 includes a printing unit 3, a tank unit 4 and a scanner unit 5. In the printer 1000, the tanks 10 are placed in a housing 6 of the printing unit 3. In other words, in the printer 1000, the housing 7 of the tank unit 4 shown in FIG. 1 is integrally included in the housing 6. In the printer 1000, the housing 6 has a cover 401 as shown in FIG. 23. The cover 401 is configured to be rotatable relative to the housing 6. The cover 401 is rotated relative to the housing 6 to be openable and closable about a center of rotation 402 described later.

As shown in FIG. 23, in the printer 1000, a plurality of tanks 10, which are illustrated as four tanks 10 in figures as an example, are placed in the housing 6. In the printer 1000, the plurality of tanks 10 are placed on a front face 22-side of the printer 1000, i.e., on a Y-axis direction side of the printer 1000. In the printer 1000, the plurality of tanks 10 are arrayed along the X axis. In the printer 1000, the X-axis direction is accordingly the direction of array of the plurality of tanks 10.

The cover 401 includes a window 25. The window 25 is provided in the front face 22 of the housing 6. The window 25 has light permeability. The tanks 10 are provided in a location overlapping with the window 25. This configuration enables an operator using the printer 1000 to observe the tanks 10 via the window 25. According to this embodiment, the window 25 is provided as an opening formed in the cover 401. The window 25 provided as the opening is closed by a member 403 having light permeability. This configuration enables the operator to observe visible walls 404 of the tanks 10 via the window 25 provided as the opening. According to another configuration, the member 403 provided to close the window 25 may be omitted. This configuration with omission of the member 403 provided to close the window 25 also enables the operator to observe the visible walls 404 of the tanks 10 via the window 25 provided as the opening.

According to this embodiment, at least part of the visible wall 404 of the tank 10 has light permeability. Ink contained in the tank 10 is visible through the part of the visible wall 404 having light permeability. The liquid surface in the tank 10 is thus visible through the part of the visible wall 404 having light permeability. Accordingly the operator can observe the four tanks 10 via the window 25, so as to visually check the amounts of inks contained in the respective tanks 10. Accordingly, the part of the visible wall 404 having light permeability may be used as the visible portion that allows the amount of ink to be visually checked. According to another configuration, the entire visible wall 404 may have light permeability.

Figure 24:
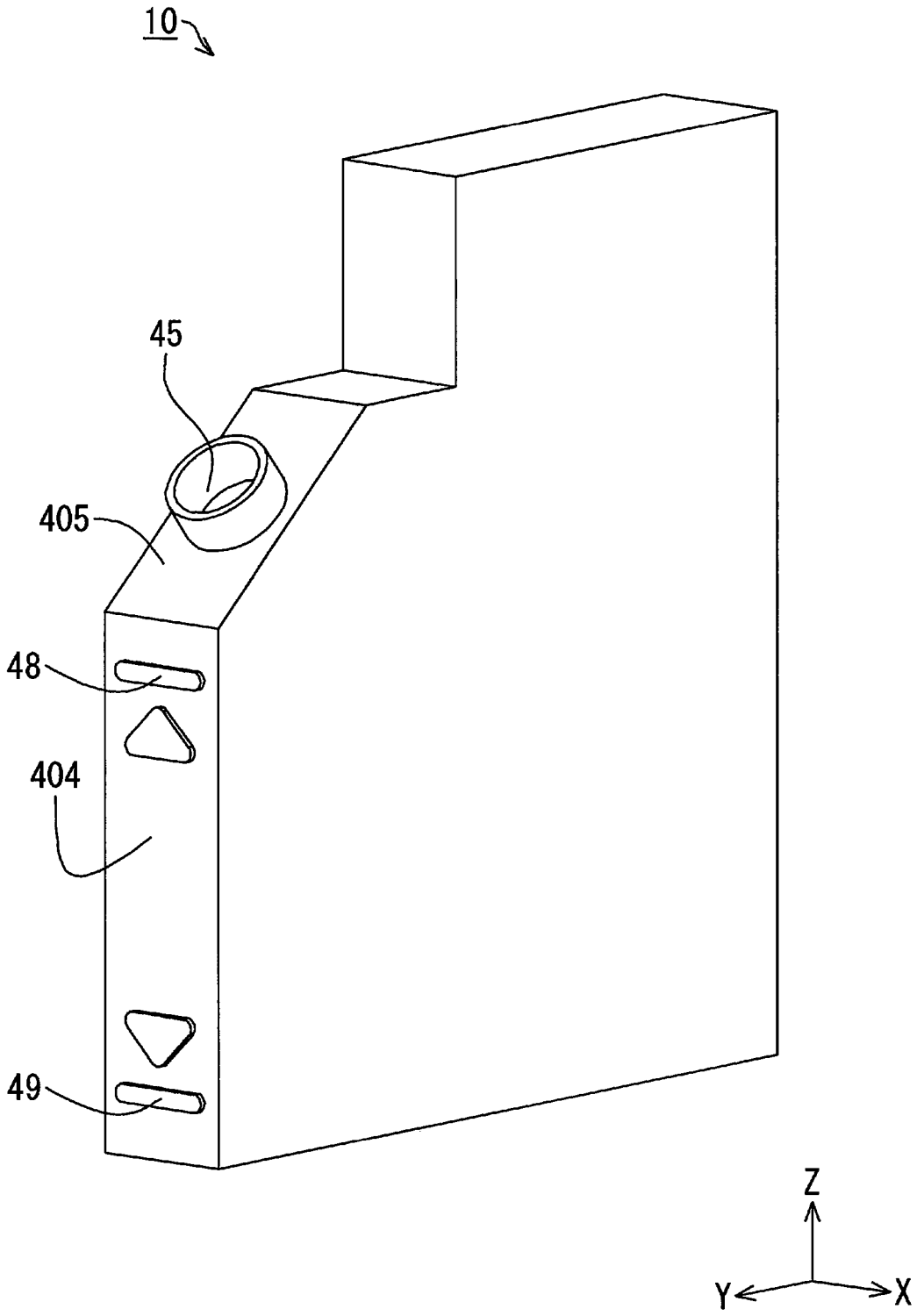
FIG. 24 is a perspective view illustrating a tank according to another embodiment.

In the tank 10 of the printer 1000, an injection portion 45 is provided in a wall 405 as shown in FIG. 24. The wall 405 is inclined in the use attitude of the printer 1000. The wall 405 is inclined toward the −Y-axis direction side from the −Z-axis direction side to the Z-axis direction side. Accordingly the wall 405 is arranged to face in a direction intersecting with the vertical direction. The visible walls 404 described above are extended in a direction intersecting with the wall 405.

Figure 25:
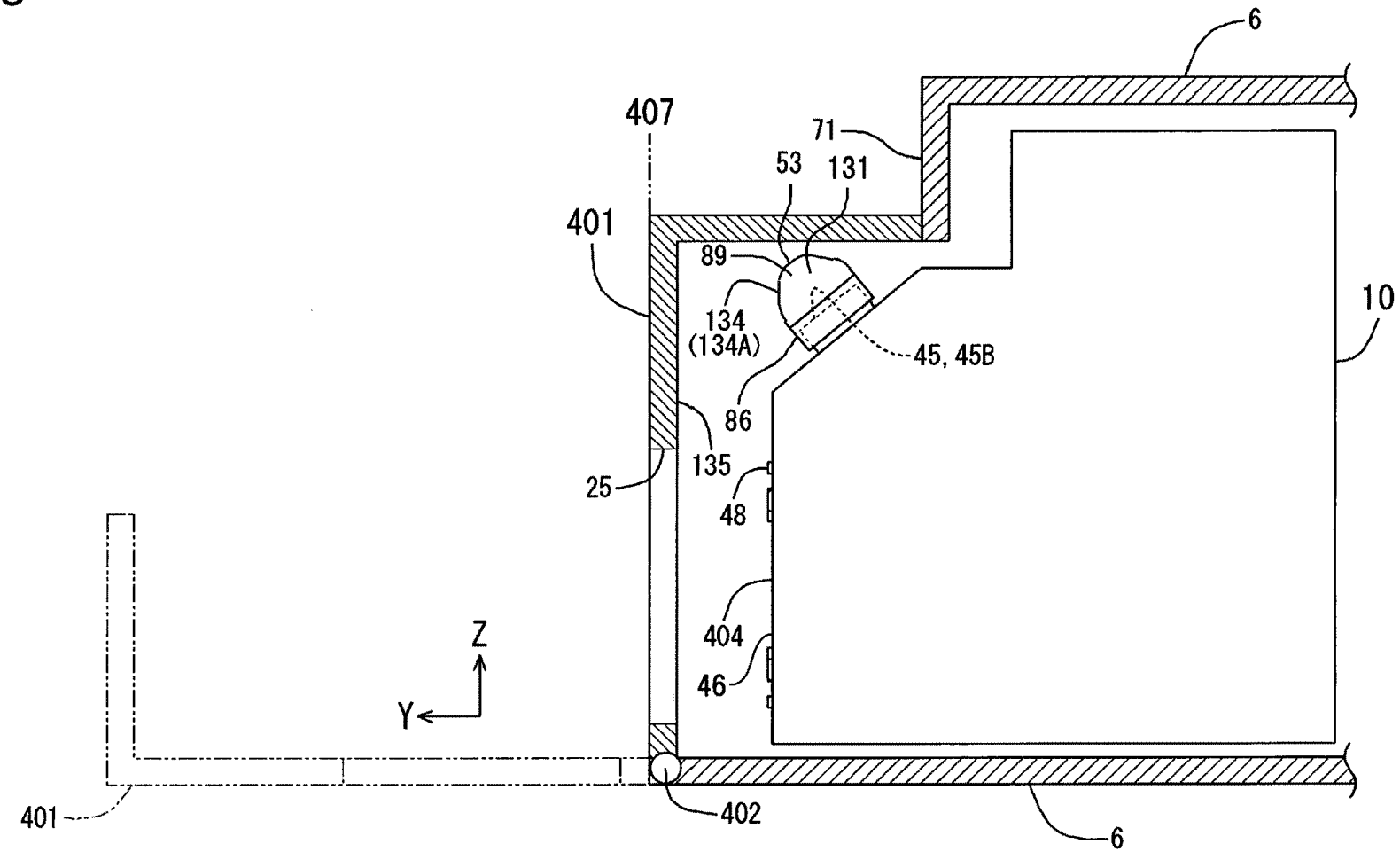
FIG. 25 is a sectional view illustrating the printer according to another embodiment.

In the printer 1000, the cover 401 is rotated relative to the housing 6 to be openable and closable about the center of rotation 402 as shown in FIG. 25 that is a sectional view illustrating the housing 6 and the cover 401. In the printer 1000, the center of rotation 402 is located below the visible wall 404 of the tank 10. FIG. 25 is a sectional view schematically illustrating the housing 6 and the cover 401 taken along a YZ plane. In the printer 1000, a cap 53 is attached to the injection portion 45 of the tank 10.

In FIG. 25, the cover 401 is illustrated by a solid line at a closed position where the cover 401 is closed to the housing 6. The cover 401 is illustrated by a two-dot chain line, on the other hand, at an open position where the cover 401 is opened relative to the housing 6. At the closed position, the injection portion 45 of the tank 10 is covered by the cover 401. At the open position, on the other hand, the injection portion 45 is opened in the state that the cap 53 is removed from the injection portion 45. In the printer 1000, the center of rotation 402 is extended along the X axis.

In other words, the injection portion 45 of the tank 10 is exposed at the open position of the cover 401 in the state that the cap 53 is removed from the injection portion 45. The operator places the cover 401 at the open position to make the injection portion 45 of the tank 10 accessible from outside of the housing 6. At the open position of the cover 401, the operator may inject ink contained in a bottle or the like through the injection portion 45 into the tank 10. The operator is allowed to inject ink into the injection portion 45 while checking the amount of ink in the tank 10 through the visible wall 404.

In the printer 1000, as shown in FIG. 25, the cap 53 is located between the housing 6 and the cover 401 along the Y axis when the cover 401 is closed to the housing 6 in the state that the cap 53 is attached to the injection portion 45 of the tank 10. When the printer 1000 is viewed vertically downward in the use attitude of the printer 1000, the cap 53 is located at a position on a second direction side of one side 407, i.e., at a position on the −Y-axis direction side of one side 407 as shown in FIG. 25. The second direction herein denotes a direction from one side 407 toward ink fill ports 45B that intersects with a first direction along one side 407 shown in FIG. 23. In the printer 1000, a direction along the Y axis corresponds to the first direction, and a direction along the X axis corresponds to the second direction.

The housing 6 is located at a position on the −Y-axis direction side of the cap 53, and the cover 401 is located at a position on the Y-axis direction side of the cap 53. The configuration of this embodiment suppresses a covering portion 86 and a grip portion 89 of the cap 53 from coming into contact with the cover 401 and the housing 6 when the cover 401 is closed to the housing 6 in the state that the cap 53 is attached to the injection portion 45 of the tank 10. In other words, in the printer 1000, the cap 53 is placed in a closed space between a covered portion 71 of the housing 6 and an inner face 135 of the cover 401 when the cover 401 is closed to the housing 6 in the state that the cap 53 is attached to the injection portion 45 of the tank 10. This configuration enables the cover 401 to be securely closed to the housing 6 in the state that the cap 53 is attached to the injection portion 45 of the tank 10.

This is implemented by sloped parts 134 provided on grip portion 89. The sloped part 134 is formed such that a gap is formed between the grip portion 89 and the cover 401 in the state that grip faces 131 are arranged along the YZ plane when the cap 53 is attached to the injection portion 45 of the tank 10. More specifically, there is a gap between the cover 401 and a sloped part 134A that is located closer to the cover 401 in the Y-axis direction out of the two sloped parts 134. The configuration of the printer 1000 exerts the similar advantageous effects to those of the printer 1.

As shown in FIG. 4, FIG. 9 and FIG. 20, in the printer 1, there is a gap between the cap 53 and an edge of the main body 52A (covered portion 71) of the housing 7 that defines the opening 74 in the state that the cap 53 is attached to the tank 10. This configuration allows the cap 53 to pass through the opening 74 of the main body 52A. In the printer 1, the ink fill port 45B is exposed through the opening 74 that is formed in the main body 52A to cover at least part of the portion of the tank 10 other than the ink fill port 45B. In the printer 1, there is a gap between the cap 53 and the edge of the main body 52A that defines the opening 74 in the state that the cap 53 is attached to the ink fill port 45B of the tank 10 to close the ink fill port 45B. This configuration of the printer 1 enables the main body 52A of the housing 7 to be dismounted from the printer 1, for example, in the state that the cap 53 is attached to the tank 53. In other words, the main body 52A is demountable from the printer 1, while the cap 53 is kept attached to the tank 10. This configuration thus suppresses invasion of any foreign substance such as dirt or dust through the ink fill port 45B into the tank 10 when the main body 52A is dismounted from the printer 1. The presence of the gap between the ink fill port 45B and the edge of the main body 52A that defines the opening 74 enables ink adhering to the inclined face 136 surrounding the ink fill port 45B to be wiped out via this gap.

The printer 1 may be configured to be provided with an absorber that is capable of absorbing ink on the inclined face 136 surrounding the ink fill port 45B of the tank 10. The configuration having the absorber enables ink dripping off to the circumference of the ink fill port 45B, for example, in the process of injecting ink into the ink fill port 45B to be absorbed by the absorber. This reduces the possibility that inside of the housing 7 is stained with ink. When the absorber is filled with ink, the ink-filled absorber is replaceable with a new absorber by dismounting the main body 52A from the printer 1. The above configuration having a gap between the cap 53 and the edge of the main body 52A that defines the opening 74 may be further employed in the configuration having the absorber. This suppresses, for example, ink dripping off from the absorber or the main body 52A from entering the ink fill port 45B in the process of replacement of the absorber with a new absorber.

Figure 26:
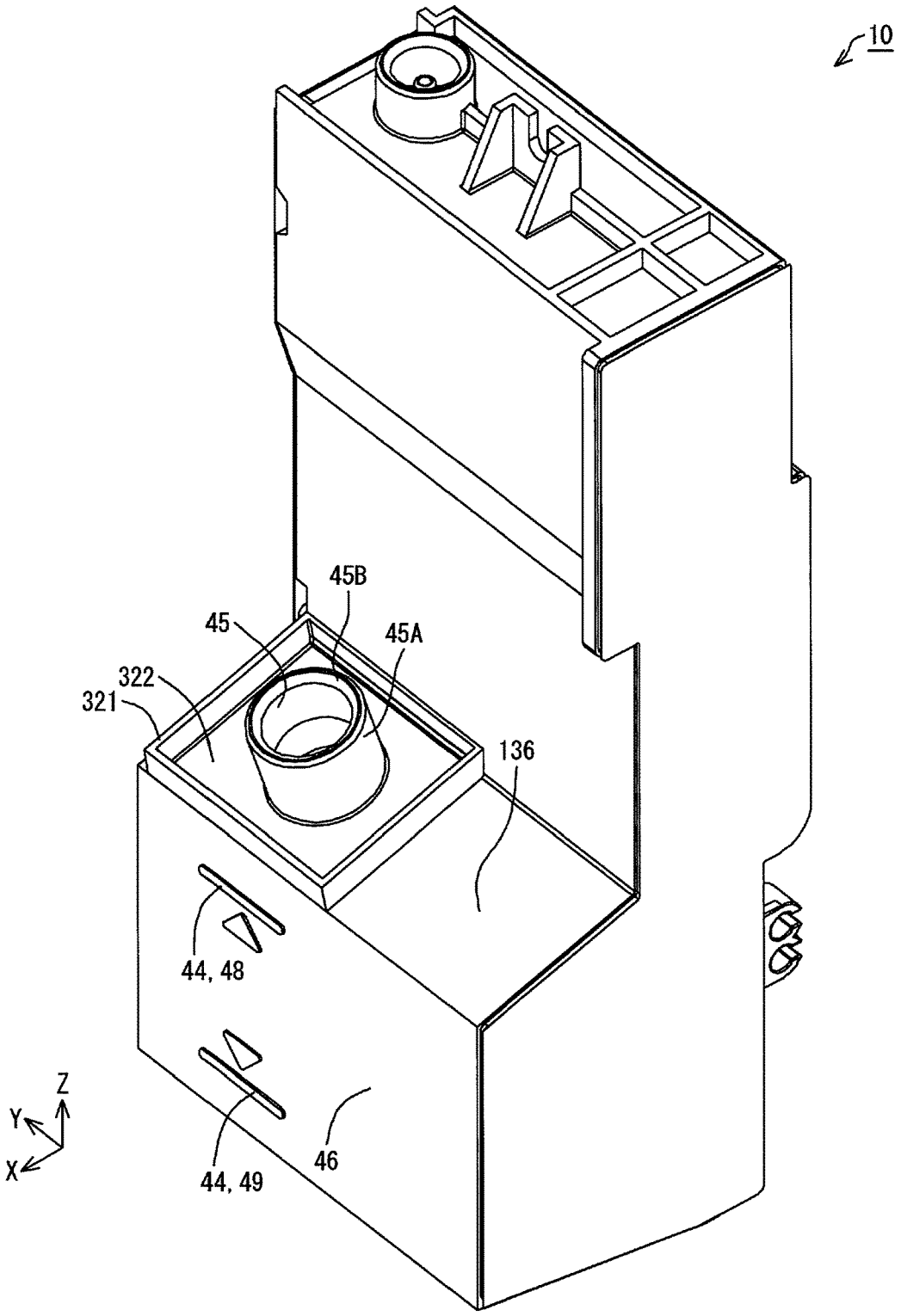
FIG. 26 is a perspective view illustrating the tank according to the embodiment.

According to the embodiment, as shown in FIG. 26, a surrounding wall 321 is provided on the inclined face 136 of the tank 10. The surrounding wall 321 is provided in a ring shape outside of the injection portion 45 to surround the injection portion 45. The surrounding wall 321 is protruded upward from the inclined face 136. The surrounding wall 321 is also inclined according to the inclination of the inclined face 136. Accordingly the surrounding wall 321 is protruded from the inclined face 136 in the same direction as the direction of protrusion of the cylinder portion 45A from the inclined face 136. In the tank 10, the surrounding wall 321 traps ink dripping off to the circumference of the ink fill port 45B, for example, in the process of injecting ink into the ink fill port 45B. This configuration reduces the possibility that the ink dripping off to the circumference of the ink fill port 45B is spread to a wider area.

The tank 10 having the surrounding wall 321 may adopt the configuration provided the above absorber. In this case, the absorber may be placed in an area 322 surrounded by the surrounding wall 321. This configuration further reduces the likelihood of spread of the ink dripping off to the circumference of the ink fill port 45B. According to this embodiment, the surrounding wall 321 provided on the tank 10 is covered by the main body 52A of the housing 7. The surrounding wall 321 is accordingly invisible in the state that the tank 10 is placed in the main body 52A. The above configuration having a gap between the cap 53 and the edge of the main body 52A that defines the opening 74 may be further employed in the configuration including the absorber placed in the area 322 surrounded by the surrounding wall 321. This enables the main body 52A to be dismounted from the printer 1 while the cap 53 is kept attached to the tank 10 in the process of replacement of the absorber with a new absorber. This suppresses, for example, ink dripping off from the absorber or the main body 52A from entering the ink fill port 45B in the process of replacement of the absorber with a new absorber. The surrounding wall 321 may be provided in part of the area of the inclined face 136 or may be provided over the entire area of the inclined face 136. The configuration that the surrounding wall 321 is provided over the entire area of the inclined face 136 increases the volume of ink trapped by the surrounding wall 321. Another advantage of the configuration that the surrounding wall 321 is provided over the entire area of the inclined face 136 is size expansion of the absorber. For the purpose of maintenance as described above, for example, replacement of the absorber may be conducted by lifting up the main body 52A of the housing 7 in the state that the ink fill port 45B is closed by the cap 53. When the anchor portion 85 of the cap 53 is connected with the connecting portion 84 like the embodiment shown in FIG. 4, disconnection of the anchor portion 85 from the connecting portion 84 further facilitates dismounting of the main body 52A.

In any of the aspects and the embodiments described above, the liquid ejection apparatus may be a liquid ejection apparatus configured to inject, eject or apply and thereby consume any liquid other than ink. The state of a liquid ejected in the form of tracing amounts of droplets from the liquid ejection apparatus may include a granular shape, a teardrop shape and a tapered threadlike shape. The liquid herein may be any material that is consumable by the liquid ejection apparatus. The liquid may be any material in the liquid phase. The liquid may be, for example, any material in the liquid phase. The liquid may include, for example, liquid-state materials of high viscosity or low viscosity, sols, aqueous gels and other fluids including inorganic solvents, organic solvents, solutions, liquid resins and liquid metals including metal melts. The liquid is not limited to the liquid state as one of the three states of matter but may include solutions, dispersions and mixtures of the functional solid material particles, such as pigment particles or metal particles, solved in, dispersed in or mixed with a solvent. Typical examples of the liquid may include ink described in the above embodiments and liquid crystal. The ink herein may include general water-based inks and oil-based inks, as well as various liquid compositions, such as gel inks and hot-melt inks. Additionally, a sublimation transfer ink may be used as the ink. The sublimation transfer ink is, for example, an ink including a sublimation color material such as a sublimation dye. An available printing method may eject such a sublimation transfer ink from the liquid ejection apparatus to a transfer medium and heat the transfer medium that is in contact with a substrate, so as to sublimate the color material and thereby transfer the color material to the substrate. The substrate may be, for example, a T-shirt or a smartphone. Using the ink including the sublimation color material allows for printing on a wide variety of substrates besides printing media. The liquid ejection apparatus may include, for example, a liquid ejection apparatus configured to eject a liquid that includes a material such as an electrode material or a color material in the form of a dispersion or in the form of a solution and is used for manufacturing liquid crystal displays, EL (electroluminescence) displays, field emission displays, and color filters. The liquid ejection apparatus may also include a liquid ejection apparatus configured to eject a bioorganic material used for manufacturing biochips, a liquid ejection apparatus used as a precision pipette and configured to eject a sample liquid, a printing apparatus and a microdispenser. The liquid ejection apparatus may further include a liquid ejection apparatus for pinpoint ejection of lubricating oil on precision machines such as watches and cameras and a liquid ejection apparatus configured to eject a transparent resin solution, such as an ultraviolet curable resin solution, onto a substrate in order to manufacture a hemispherical microlens such as an optical lens, used for, for example, optical communication elements. Another example of the liquid ejection apparatus may be a liquid ejection apparatus configured to eject an acidic or alkaline etching solution in order to etch a substrate or the like.

The disclosure is not limited to any of the embodiments and the examples described above but may be implemented by a diversity of other configurations without departing from the scope of the disclosure. For example, the technical features of any of the embodiments and the examples corresponding to the technical features of each of the aspects described in SUMMARY may be replaced or combined appropriately, in order to solve part or all of the problems described above or in order to achieve part or all of the advantageous effects described above. Any of the technical features may be omitted appropriately unless the technical feature is described as essential herein.

What is claimed is:

1. A cap configured to be attached to and detached from a tank, the tank comprises a container body configured to contain an ink to be supplied to a print head; and an ink fill port configured to accept the ink to be injected into the container body, and the cap configured to close the ink fill port when the cap is attached to the tank, the cap comprising:

a covering portion configured to cover the ink fill port;

a seal portion protruding from the covering portion to be inserted into the ink fill port and configured to close the ink fill port when the seal portion is inserted in the ink fill port;

a skirt portion located outside of the seal portion when the covering portion is viewed from a seal portion side, and protruding from the covering portion in a direction of protrusion of the seal portion from the covering portion; and a grip portion protruding from the covering portion toward an opposite side that is opposite to an ink fill port side, and provided in a plate-like form, wherein the skirt portion protrudes more than the seal portion.

2. The cap according to claim 1, wherein the grip portion comprises a sloped part that is sloped progressively inward of an area of the covering portion from a covering portion side to an opposite end of the grip portion that is opposite to the covering portion side, and the sloped part is provided over from the covering portion side to the opposite end of the grip portion.

3. The cap according to claim 2, wherein the ink fill port is inclined to a vertical direction in a use attitude of the tank, and the sloped part is sloped according to inclination of the ink fill port.

4. The cap according to claim 2, wherein the grip portion comprises:

two sloped parts opposed to each other in a direction intersecting with a center axis of the cap; and two flat portions configured to connect the two sloped parts with each other and arranged opposite to each other to be approximately parallel to a center axis direction of the ink fill port when the cap is attached to the ink fill port.

* * * * *